US012582272B2

(12) United States Patent
Matters

(10) Patent No.: US 12,582,272 B2
(45) Date of Patent: Mar. 24, 2026

(54) BODILY WASTE HARVESTING, PATHOGEN DESTROYING, WATERLESS TOILET

(71) Applicant: Robert Matters, Sturgeon Lake, MN (US)

(72) Inventor: Robert Matters, Sturgeon Lake, MN (US)

( * ) Notice: Subject to any disclaimer, the term of this patent is extended or adjusted under 35 U.S.C. 154(b) by 196 days.

(21) Appl. No.: 18/235,475

(22) Filed: Aug. 18, 2023

(65) Prior Publication Data

US 2024/0057826 A1 Feb. 22, 2024

Related U.S. Application Data

(60) Provisional application No. 63/400,001, filed on Aug. 22, 2022.

(51) Int. Cl.
*A47K 11/12* (2006.01)

(52) U.S. Cl.
CPC ..... *A47K 11/12* (2013.01)

(58) Field of Classification Search
CPC .. E03D 9/04; E03D 9/05; E03D 9/052; A47K 11/12; A61G 9/00
See application file for complete search history.

(56) References Cited

U.S. PATENT DOCUMENTS

| | | | | |
|---|---|---|---|---|
| 6,021,531 | A * | 2/2000 | Kirko | A47K 11/12 4/144.1 |
| 9,957,703 | B2 * | 5/2018 | Porter | E03D 9/052 |
| 10,568,473 | B2 * | 2/2020 | Le | A61F 5/451 |
| 2017/0007082 | A1 * | 1/2017 | Li | A47K 11/03 |
| 2018/0258626 | A1 * | 9/2018 | Lee | E03D 9/052 |

* cited by examiner

*Primary Examiner* — Janie M Loeppke
(74) *Attorney, Agent, or Firm* — Dykema Gossett PLLC

(57) ABSTRACT

A urine-harvesting urinal includes a collection conduit having a top opening, a bottom opening, and a side opening disposed on a wall of the collection conduit, a first venting conduit having a first opening near a first end of the first venting conduit and a second opening at a second end of the first venting conduit, configured to transfer air away from the collection conduit and configured to provide negative air pressure, a transition conduit, connecting the side opening of the collection conduit to the first opening of the first venting conduit, and a storage conduit having a first opening near a first end of the storage conduit and a second opening at a second end of the storage conduit, the first opening connected to the bottom opening of the collection conduit and configured to transfer fluids away from the collection conduit toward an external storage location.

20 Claims, 16 Drawing Sheets

BODILY WASTE HARVESTING, PATHOGEN DESTROYING, WATERLESS TOILET

CROSS-REFERENCE TO RELATED APPLICATIONS

This application claims the benefit of U.S. provisional application No. 63/400,001, filed 22 Aug. 2022, which is hereby incorporated by reference in its entirety as though fully set forth herein.

BACKGROUND OF THE DISCLOSURE a. Field

The present disclosure relates to systems and methods for harvesting bodily waste and destroying pathogens in a waterless toilet.

b. Background Art

Composting toilets have not lived up to their promise and potential because they do not destroy pathogens. First, it is important to point out that all composting toilets are not created equal. There are two types of composting toilets currently available for sale to the public around the world.

One of the most common that is manufactured and distributed globally are small self-contained units, suitable only for occasional use. Such toilets are often used in RVs, boats, cabins, etc. They are marketed as composting toilets by their manufacturers, but what little composting that could possibly take place in these small devices is only tertiary at best.

The second type of composting toilets are designed for daily, year-round use in various settings from places of business to public buildings and homes or permanent residences. This type comprises a composting chamber that sits apart from the toilet or stool, usually directly beneath the toilet or offset somewhat.

BRIEF SUMMARY OF THE INVENTION

In one embodiment, a urine-harvesting urinal can comprise a collection conduit comprising a top opening, a bottom opening, and a side opening disposed on a wall of the collection conduit closer to the bottom opening than the top opening, a first venting conduit comprising a first opening near a first end of the first venting conduit and a second opening at a second end of the first venting conduit, the second opening configured to transfer air away from the collection conduit, the first venting conduit configured to provide negative air pressure, a transition conduit, connecting the side opening of the collection conduit to the first opening of the first venting conduit, and a storage conduit comprising a first opening near a first end of the storage conduit and a second opening at a second end of the storage conduit, the first opening of the storage conduit connected to the bottom opening of the collection conduit and configured to transfer fluids away from the collection conduit toward an external storage location.

These and various other advantages and features of novelty which characterize the present invention are pointed out with particularity in the claims annexed hereto and forming a part hereof. However, for a better understanding of the invention, its advantages and objects obtained by its use, reference should be made to the drawings which form a further part hereof, and to the accompanying descriptive matter, in which there is illustrated and described preferred embodiments of the present invention.

DETAILED DESCRIPTION OF EMBODIMENTS

Figure 1:
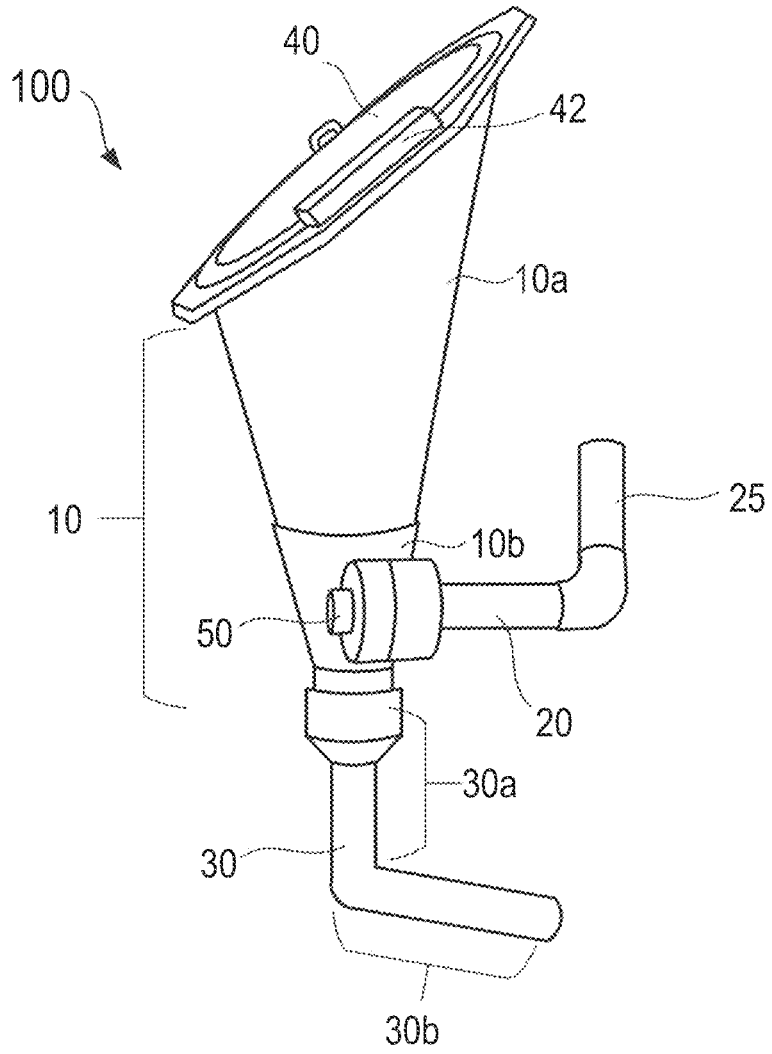
FIG. 1 is a side view of a urine-harvesting urinal, in accordance with an embodiment of the present description.

In the following description, reference is made to the accompanying drawings that form a part hereof and in which various embodiments are shown by way of illustration. The drawings are not necessarily to scale. It is to be understood that other embodiments are contemplated and may be made without departing from the scope or spirit of the present description. The following detailed description, therefore, is not to be taken in a limiting sense.

The disclosed devices, systems, and methods address the universal need to prevent human excreta from harming environmental and human health. This need can be met by making a dry composting toilet comprising components that transform feces into a dry odorless material that both significantly reduces its volume and destroys pathogens in situ, allowing safe periodic removal for further processing and subsequent appropriate uses. One of the components comprises the use of two hot water bath containment vessels for feces and carbonaceous additives which induces thermophilic aerobic bacterial activity that in turn produces more heat sufficient to destroy pathogens. In some embodiments, solar thermal collectors and tankless water heaters may comprise external sources of heat for the hot water bath containment vessels.

In addition, the devices, systems, and methods described herein include collecting and processing urine onsite that can also destroy potential pathogens while maintaining the nutritive value of key elements that reside in the undiluted, stored urine for subsequent and safe use as an agricultural fertilizer.

Numerous studies have been conducted by institutions around the world on removing urine from the wastewater flow and utilizing it as an agricultural fertilizer. In general, the findings of these studies show that urine comprises a very small fraction (less than 1%) of the flow entering public sewage treatment plants and private septic systems, but that it carries a large portion of the total nutrient load the systems receive (i.e., about 80% of the nitrogen and 50% of the phosphorous). Removal of these nutrients can be very difficult and extremely costly. Even the most advanced systems are stressed by ever increasing flows.

The key elements, nitrogen and phosphorus, are needed by both aquatic and terrestrial plants in order to survive and thrive. However, in amounts too great, these essential elements can be toxic, especially for aquatic plants. Excess nitrogen and phosphorus in "treated" water returned to waterways from sewage treatment plants and septic systems, combined with excess fertilizer run-off from agricultural cropland, can lead to over-fertilization of aquatic plants.

There are a variety of existing methods worldwide for harvesting urine. A common urine harvesting method is a simple chamber pot or night pot. The urine collected is usually used the next day and applied directly to agricultural crops as fertilizer. Problems with this manual collection method include odor, spillage, and the loss of nitrogen to the atmosphere through evaporation, making the urine less effective as a fertilizer. Urine collected in this manner is also potentially unsanitary and unhygienic, and transportation to the fields and applying the urine to the crops is inefficient.

A second method of urine harvesting is a urine-separating flush toilet. A urine-separating flush toilet has a bowl which is separated into two sections. Urine is collected in the front section, and the water supply flushes the front section separately. The urine-separating flush toilet has several disadvantages. The undiluted urine collected in the front section may have an odor. There can be a problem with splash back from urine striking the front section. Men are required to sit during urination for the most efficient urine collection. The front section has its own drain trap, and valuable minerals from the urine can precipitate and create deposits in the drain trap and/or subsequent drainpipes. Flushing the front section with water causes an unnecessary dilution of the urine that is collected and increases the amount of storage and transportation capacity required.

A third method for harvesting urine uses a waterless urinal. These are typically installed in public restrooms and connected to a conventional sewer drain. The waterless urinal does not use water to wash the urine down a drain. Instead, a waterless urinal has a removable trap at the base of the urinal that allows urine to drain away but does not allow sewer gas to escape. These waterless systems have some unique disadvantages. Because the waterless urinal is not flushed with water, urine residue clings to the receptacle and can create an odor after use. The trap used at the bottom of the receptacle can create a slower flow of urine, leading to sedimentation and the loss of nutrients, as well as build-up on drainpipes.

A fourth method of urine harvesting uses composting toilets that divert urine to a common collection/storage point. Like the urine-separating flush toilets, they divide the opening under the seat into two parts, which means they share the disadvantages of the urine-separating flush toilets, including residual odor and sedimentation. The front portion usually takes the form of a bowl-like receptacle with a rather small drain hole for the urine to drain via a tube or hose to some sort of storage container.

What is needed in the art is a urine-harvesting system which eliminates the disadvantages of existing urine-harvesting methods, including, but not limited to, residual odor, dilution of the collected nutrients, and the problems related to sedimentation of the urine (e.g., from drain traps or slow draining receptacles.)

Some of the varieties of the daily use type of composting toilets do not divert urine. In other words, the urine falls directly into the chamber below. In most cases this results in anaerobic conditions, which produces malodorous "sewer gasses" such as hydrogen sulfide (the rotten egg smell) and methane, though odorless, it and its smelly, sister gasses emitted by the anaerobic conditions these toilets produce are super potent "greenhouse" gasses. Some of these types of toilets aren't even waterless. They feature foam flush or ultra-low water flush systems. This is not composting—though they may still be sold as such. These "composting" chambers are really no more than holding tanks. In many cases, the manufacturers of these toilets recommend draining excess fluids to "French pit drains" (generally pea-rock or gravel filled pits). These toilets likely don't reduce pathogens and, in contrast, likely increase pathogen populations as they produce even more greenhouse gasses.

While these toilets may involve some composting, the composting stays in the much cooler mesophilic stage. None of them ever reach the thermophilic stage. For that to occur temperatures within the solid waste chamber has to reach 105-110 F. It can and does occur naturally, but not in these composters. Thermophilic aerobic activity occurs only if the right conditions combine to suit the goldilocks thermophiles. The compost pile must be quite large, so the inner parts of the pile are well insulated, allowing slow warming through stages of mesophilic bacterial activity. Then there must be enough water, but not too much; enough air, but not too much (making conditions too cool). The solid waste within these systems can comprise feces, toilet paper and a carbonaceous additive i.e. sawdust, rice hulls, chopped crop residue, peat moss etc.—all of which is combined and hereinafter referred to as humanure.

Some manufactures have cleverly resorted to batch composters: within a larger circular enclosure; a turn-table with separate pie-shaped bins are situated. When one bin is full the turn-table is rotated and another bin is filled, and so on. These batch composters have 3 to 6 bins. It was hoped that this would allow plenty of time for the mesophilic bacteria to slowly heat up humanure in the first bin before it came back around to the start to reach the thermophilic stage. As mentioned above, the bins are just not big enough. No matter how long the humanure sits there, the thermophiles just won't wake up unless it gets hot enough first. There have been attempts to heat the air within the chamber in the hope the humanure would heat up sufficiently, but that method hasn't worked either. Even when super-heating the air to 130 F the experiments did not attain the sought for thermophilic activity.

Human urine can be ruinous to water quality. Human urine accounts for less than 1% of the flow that ends up in private septic drain fields and municipal "wasted" water treatment plants (WWTPs). Yet it accounts for 50-80% of the nutrient load that should be removed (but most likely is not) before it continues its way to our surface waters (rivers) and into the sea. That same <1% of the flow also accounts for 100% of the unmetabolized pharmaceuticals, food additives, recreational drugs, hormones and other ingested compounds now found in measurable amounts in most of our surface waters, and even tap water (where it is derived from surface water).

Those nutrients in urine, primarily Nitrogen(N) and Phosphorous(P) are great fertilizers. In newer more efficient WWTPs most of the Nitrogen gets removed (albeit at great cost). Phosphorous is even harder to remove, at even greater cost. Unfortunately, most of our WWTPs aren't new and efficient. As a result, a lot of the Nitrogen and Phosphorous from our urine ends up in our rivers. The problem is that N and P are equal opportunity fertilizers. They not only fertilize ground crops they also fertilize algae and other aquatic plants, and that's the problem. Because in water, they combine with all of the excess Nitrogen and Phosphorous from agricultural run-off, resulting in monstrous algal blooms and super dense weed mats. All of the unnatural growth removes the oxygen out the water. The end result is de-oxygenated dead zones in major waterways. One dead zone in the Gulf of Mexico is the size of the state of Connecticut thanks to the nutrient-filled waters brought there by the Mississippi River.

Human urine is a valuable crop fertilizer that is not utilized. Water is used to flush urine that contributes to the destruction of surface waters. Instead, the urine should be used for the purpose for which it seems intended—as a fertilizer to grow crops.

Human urine is a powerful Nitrogen fertilizer that carries Phosphorus and Potassium (K) too. The NPK ratio is roughly 13:2:4 with other important macro and micronutrients present as well. All of these nutrients are present in their ionic form, so they can be readily absorbed by plant roots. For decades the use of human urine as a fertilizer has been the subject of many studies and research around the globe beginning in the 1990s at the School of Agriculture at the University of Uppsala in Sweden under the direction of the lead investigator Dr. Hakan Jonsson. Since then notable studies have replicated and built upon those pioneering Swedish efforts in Finland, Germany, Switzerland, South Africa, and in the US.

The Rich Earth Institute in Brattleboro, Vermont has been exploring the use of human urine as a fertilizer with a number of experiments. The University of Michigan is currently collaborating as coinvestigators, along with numerous other institutions, in the first major US based study. The National Science Foundation funded study is looking at various methods of processing urine into agricultural fertilizer products. The potential is enormous; according to the University of Michigan's website announcing the study: "9 Billion Pounds—the amount of chemical fertilizer that could be replaced by urine produced by Americans each year". Storage of undiluted urine can eliminate potential pathogens in 60 days, and stored long enough, gene carrying plasmids break apart. A UMI study found that the plasmid code rings are broken apart after a year suspended in stored urine. No anti-biotic resistant bacteria production will be possible as a result of appliance onsite storage treatment.

The proposed method systems and methods herein keep it simple. Stored, safe urine pumped from storage tanks and applied directly with subsurface applicators is as safe, efficient, targeted and odor free as any fertilizer application system can be.

But what of the harmful contaminants found in urine and that end up in our surface waters. Could those same compounds pose a risk by accumulating in soils and possibly be assimilated by the plants? A study conducted by Tampere University of Applied Sciences, Tampere, Finland in conjunction with the Finnish Environment Institute, Helsinki in 2015 and 20161 took large undiluted human urine samples, stored the urine as per World Health Organization (WHO) guidelines and applied it directly by subsurface injection to soil where two varieties of barley crops and a hay crop were grown side by side by side.

The study reaffirmed that after the storage period, as prescribed by WHO, bacterial pathogens were not detectable but, that of the 55 pharmaceuticals and hormones tested for, 16 were indeed present in measurable amounts in the stored urine. However, at the end of the study those same pharmaceuticals were not detectable, either in the test plot soils, or in the plant material. This finding was similar to many previous studies worldwide. This Finnish study is yet another data point that gives further evidence that the rich microbial activity in soil readily breaks down the pharmaceuticals that are present in the urine at the time of the application. Furthermore, this same study also showed that the urine was very nearly as effective to the conventional commercial chemical fertilizer applied to the side-by-side plantings of barley, and hay in crop yield.

An earlier Swedish studies concern over the possibility of heavy metal accumulations in the soil was expressed. This is still the a drawback to applying municipal sewer sludge on ag fields. Many studies have shown that detectable, down to trace amounts, in some individuals' urine, heavy metals are present. But interestingly, the Swedish studies couldn't find even find trace amounts in soil samples. As with other compounds that are present in the urine, they appear to get disassembled within a season by the myriad microbes hard at work in the soil. The use of human urine-based fertilizers, as with any fertilizer application practice; close monitoring is necessary. Crop rotation and fertilizer applications can be altered to meet changing circumstances.

No matter which way(s) urine will be utilized as a fertilizer two important problems are addressed by the systems and methods disclosed herein: 1.) Urine must be kept out of water first place; 2.) A safe, effective method to harvest urine must be employed, regardless of how it will eventually be used.

According to some aspects of the present description, a urine-harvesting urinal includes a collection conduit, a first venting conduit, a transition conduit that connects the collection conduit and the first venting conduit, and a storage conduit. In some embodiments, the collection conduit may have a top opening, a bottom opening, and a side opening disposed on a wall of the collection conduit closer to the bottom opening than the top opening. In some embodiments, the top opening of the collection conduit may be larger than the bottom opening of the collection conduit (e.g., creating a funnel shape). In some embodiments, the first venting conduit may have a first opening near a first end of the first venting conduit and a second opening at a second end of the first venting conduit, where the second opening of the first venting conduit is configured to transfer air away from the collection conduit. In some embodiments, the first venting conduit may be configured to provide negative air pressure. In some embodiments, the transition conduit may connect the side opening of the collection conduit to the first opening of the first venting conduit, providing a pathway for odors and gases from the collection conduit into the first venting conduit. In some embodiments, the storage conduit may have a first opening near a first end of the storage conduit and a second opening at a second end of the storage conduit. In some embodiments, the first opening of the storage conduit may be connected to the bottom opening (e.g., a drain hole) of the collection conduit and configured to transfer fluids (e.g., urine) away from the collection conduit toward an external storage location.

In some embodiments, the collection conduit may include an upper section and a lower section. In some embodiments, the upper section may include the top opening of the collection conduit and a second bottom opening. In some embodiments, the lower section may include a second top opening, the side opening of the collection conduit, and the bottom opening of the collection conduit. Stated another way, the collection conduit may be configured to be a two-piece construction, with an upper section configured to collect urine and direct it into a lower section, where the lower section interfaces to the first venting conduit through the side opening (e.g., a vent pipe taking gases and odors away from the collection conduit) and interfaces to the storage conduit through the bottom opening (e.g., an exit pipe through which collected urine passes into the storage conduit). The second bottom opening of the upper section connects to (and communicates fluidically to) the second top opening of the lower section.

In some embodiments, the arrangement and configuration of the transition conduit and the first venting conduit may be such that a natural negative air pressure is created between the collection conduit and an outside venting location (e.g., outside air flow over an external vent and an upward slope on the transition conduit from the side opening of the collection conduit to the first opening of the first venting conduit may act to create a natural source of negative air pressure). In other embodiments, the first venting conduit may include, or be connected to, an exhaust fan which is configured to pull air through the first venting conduit away from the collection conduit (e.g., creating a negative air pressure which pulls odors and gases toward an outside venting location). In such embodiments, the exhaust fan may be disposed within and in-line with the first venting conduit. In other embodiments, the exhaust fan may be disposed external to and proximate the second end of the first venting conduit (i.e., at an end of the first venting conduit closest to an external vent location).

In some embodiments, the storage conduit may be disposed such that it provides a downward slope from the first end of the storage conduit (i.e., the end of the storage conduit connected to the collection conduit) toward the second end of the storage conduit (i.e., the end of the storage conduit opposite the collection conduit, perhaps leading to a storage location). In some embodiments, the downward slope of the storage conduit may be greater than or equal to 1:12, or greater than or equal to 1:10, or greater than or equal to 1:8, or greater than or equal to 1:6.

Figure 3:
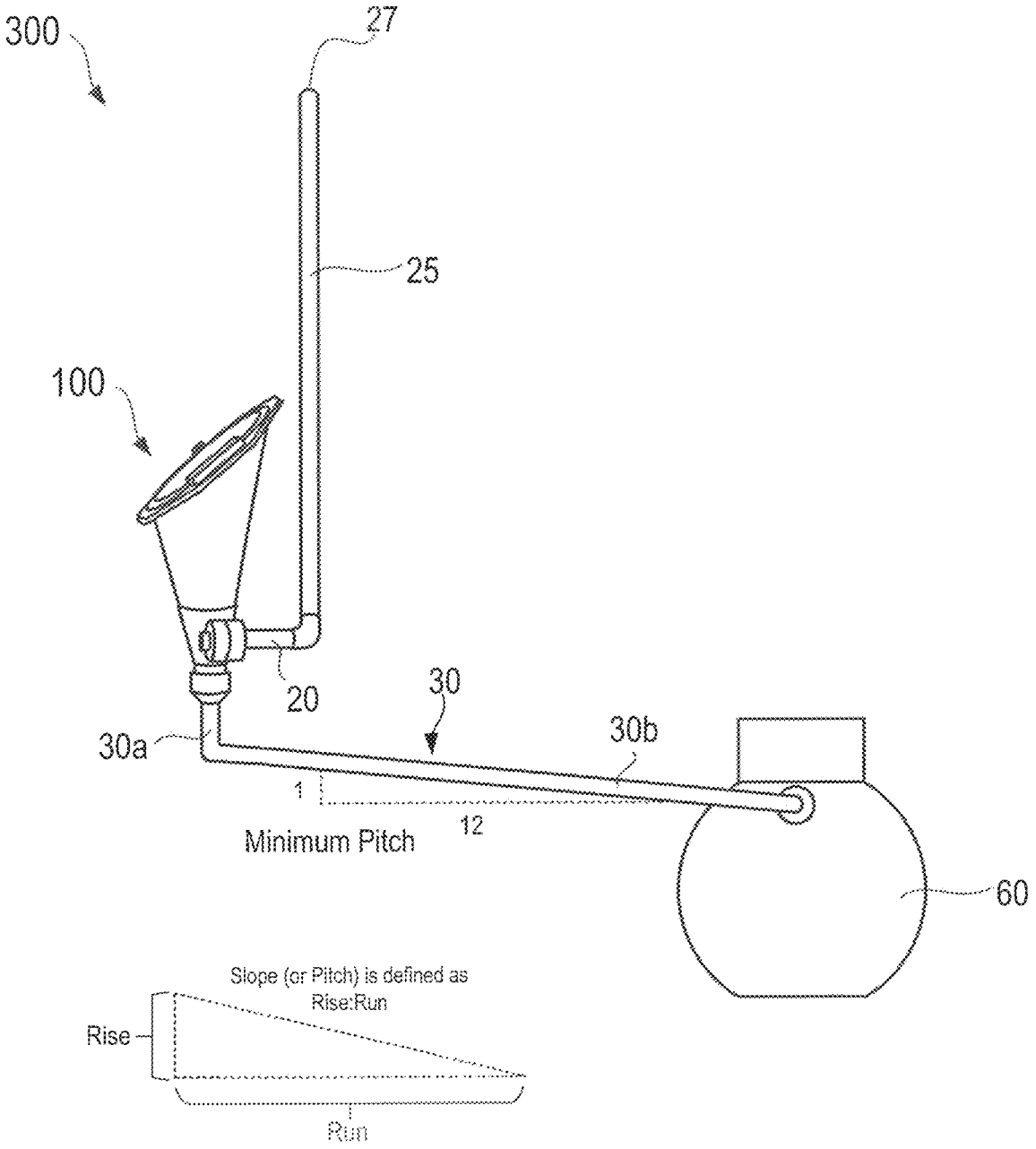
FIG. 3 is a side view of a urine-harvesting system including a storage tank, in accordance with an embodiment of the present description.

For the purposes of this specification, the slope of a conduit shall be specified as a pair of numbers separated by a colon, where the first number (to the left of the colon) is the amount of height (or vertical) change and the second number is the amount of conduit "run" or horizontal change. For example, a conduit slope of 1:12 shall be interpreted as a slope in the conduit wherein for every 1 centimeter of height change for the conduit, there should be 12 centimeters of run or horizontal change. For a slope to be greater than a specified slope (e.g., "greater than 1:12"), that means the slope must be steeper than the specified slope, or have a greater height change relative to the run change. For example, a slope of 1:8 is steeper than a slope of 1:12, as there is 1 centimeter of height change for every 8 centimeters of run. Stated another way, if you increase the height change of a slope (increase the first number) from 1:12 to 2:12 (which can be reduced to 1:6), you have a slope that is twice as steep. In general, a steeper slope will aid the draining or transit of a fluid through a conduit than a shallower slope through the same conduit, because of gravity. For the purposes of this specification, the terms "pitch" and "slope" shall be considered to be interchangeable (i.e., a "pitch of 1:12" has the same meaning as a "slope of 1:12"). The legend at the bottom of FIG. 3 provides a graphic definition of slope/pitch.

In some embodiments, the storage conduit may be substantially linear between the first end of the storage conduit and the second end of the storage conduit (i.e., there are no significant bends or drain traps in the length of the storage conduit). In some embodiments, the storage conduit may include a first section and a second section, where the first section is substantially linear in a first direction and a second section is substantially linear in a second, different location. In some embodiments, the downward slope of the first section is steeper than the downward slope of the second section. For example, the downward slope of the first section of the storage conduit may be substantially vertical, and the downward slope of the second section may be greater than or equal to about 1:12.

In some embodiments, the urine-harvesting urinal may further include a lid configured to cover the top opening of the collection conduit. The lid may be configured such that it substantially covers the top opening of the collection conduit but is not airtight when in the closed position, allowing for a continual intake of air around the lid due to the negative air pressure generated by the first venting conduit. In some embodiments, the urine-harvesting urinal may further include an operator control which can be used to selectively open and/or close the lid. For example, the operator control may be a button disposed on an exterior surface of the urine-harvesting urinal (e.g., a "shin-bump" switch which may be activated by a forward movement of the user's leg).

According to some aspects of the present description, a urine-harvesting system includes a urine-harvesting urinal according to the present description, an external venting conduit, and at least one storage tank. The external venting conduit has a first opening near a first end of the external venting conduit and a second opening near a second end of the external venting conduit. The first opening of the external venting conduit is connected to the second opening of a first venting conduit of the urine-harvesting urinal, and the second opening of the external venting conduit is open and disposed to release gases traveling through the external venting conduit into a safe exhaust location (e.g., into an outside location). The at least one storage tank is connected to the second end of the storage conduit.

In some embodiments, the storage tank may be a sealed, airtight, ventless tank. In some embodiments, the storage tank may be buried in a location external to the location of the urine-harvesting urinal (e.g., in a location outside a building housing the urine-harvesting urinal). The use of a sealed, airtight, ventless tank may enable the elimination of a physical drain "trap" (e.g., a u-bend in the drainage pipes) which can allow the urine to drain into the tank quickly and with a minimum of solid residue accumulation in the drainage pipes.

In some embodiments, as described elsewhere herein, the arrangement and configuration of the transition conduit and the first venting conduit of the urine-harvesting urinal may be such that a natural negative air pressure is created between the collection conduit and the external venting conduit (e.g., outside air flow over the second end of the external venting conduit and the upward slope on the transition conduit may act to create a natural source of negative air pressure). In other embodiments, the urine-harvesting system may include an exhaust fan which is configured to pull air through the first venting conduit away and into the external venting conduit (e.g., creating a negative air pressure which pulls odors and gases toward the external venting conduit). In such embodiments, the exhaust fan may be disposed within and in-line with the first venting conduit. In other embodiments, the exhaust fan may be disposed within and in-line with the external venting conduit. In still other embodiments, the exhaust fan may be disposed between the second opening of the first venting conduit and the first opening of the external venting conduit. In some embodiments, the external venting conduit may be disposed such that it has a steep upward slope from the first end of the external venting conduit to the second end of the external venting conduit (e.g., a substantially vertical slope leading to an outside, roof-mounted vent location).

In some embodiments, the storage conduit may be substantially linear between the first end of the storage conduit and the second end of the storage conduit. For example, in some embodiments, the downward slope of the storage conduit (between the bottom opening of the collection conduit and the storage tank) may be greater than or equal to 1:12, or greater than or equal to 1:10, or greater than or equal to 1:8, or greater than or equal to 1:6. In some embodiments, the storage conduit may include a first section and a second section, wherein the first section is substantially linear in a first direction, and the second section is substantially linear in a second, different direction. For example, the downward slope of the second section of the storage conduit may be greater than or equal to about 1:12, and the downward slope of the first section may be greater than the downward slope of the second section (and, in some embodiments, the downward slope of the first section may be substantially vertical).

Turning now to the figures, FIG. 1 is a side view of a urine-harvesting urinal, according to the present description. In some embodiments, a urine-harvesting urinal 100 includes a collection conduit 10, a first venting conduit 20, a transition conduit 55 (please see FIG. 4 for transition conduit 55), and a storage conduit 30. In some embodiments, urine-harvesting urinal 100 may further include an external venting conduit 25 connected to first venting conduit 20 and configured to transport gases created within urine-harvesting urinal 100 to a venting location. In some embodiments, the collection conduit 10 may include an upper section 10*a* and a lower section 10*b*. In such embodiments, upper section 10*a* provides the function of collecting urine from a user and directing it into lower section 10*b* (e.g., it may act as a funnel, providing a top opening that is sufficiently large to catch the urine stream). In some embodiments, collection conduit 10 may be substantially shaped as a funnel, as shown in FIG. 1, with a larger top opening and a smaller bottom opening. However, the collection conduit 10 may have any other appropriate shape, including that of a cylinder or a square conduit, for example. In some embodiments, collection conduit 10 may be a single piece, where upper section 10*a* and lower section 10*b* are merged into a single component (e.g., a single larger funnel piece).

In some embodiments, urine-harvesting urinal 100 may further include a lid 40, disposed to substantially cover a top opening in collection conduit 10. In some embodiments, lid 40 may provide a substantially gapless but not airtight perimeter around the top opening of the collection conduit 10. In some embodiments, urine-harvesting urinal 100 may further include an operator control 50 which, when activated, provides a signal to an electric motor 42 or similar mechanism which may open and/or close lid 40. In some embodiments, a first activation of operator control 50 may open lid 40 for use, and a second activation of operator control 50 may close lid 40. In some embodiments, the lid 40 may be opened and closed manually, by a user pulling the lid open or pushing it closed. In such embodiments, lid 40 may further include a feature (e.g., a handle, pull, knob, etc.) or manual mechanism (e.g., a mechanical lever, latch, catch, etc.) that may be operated by the user to open and close lid 40 manually. In embodiments featuring an operator control 50 and a corresponding mechanism (e.g., electric motor 42) for opening and closing lid 40, a user may be able to manually override the mechanism by manually opening and closing lid 40.

In some embodiments, storage conduit 30 may have a first section 30*a* and a second section 30*b*. In some embodiments, first section 30*a* may be substantially vertical (e.g., providing a vertical or nearly vertical drop from the bottom of collection funnel 10 of urine into second section 30*b*). In some embodiments, first section 30*a* may have a slope that is greater than (steeper than) or equal to 10:1, or 12:1, or 20:1, or 50:1. In some embodiments, second section 30*b* may have a downward slope that is at least 1:12 or steeper to provide adequate transportation of urine to a storage tank (see FIG. 3).

Figure 2:
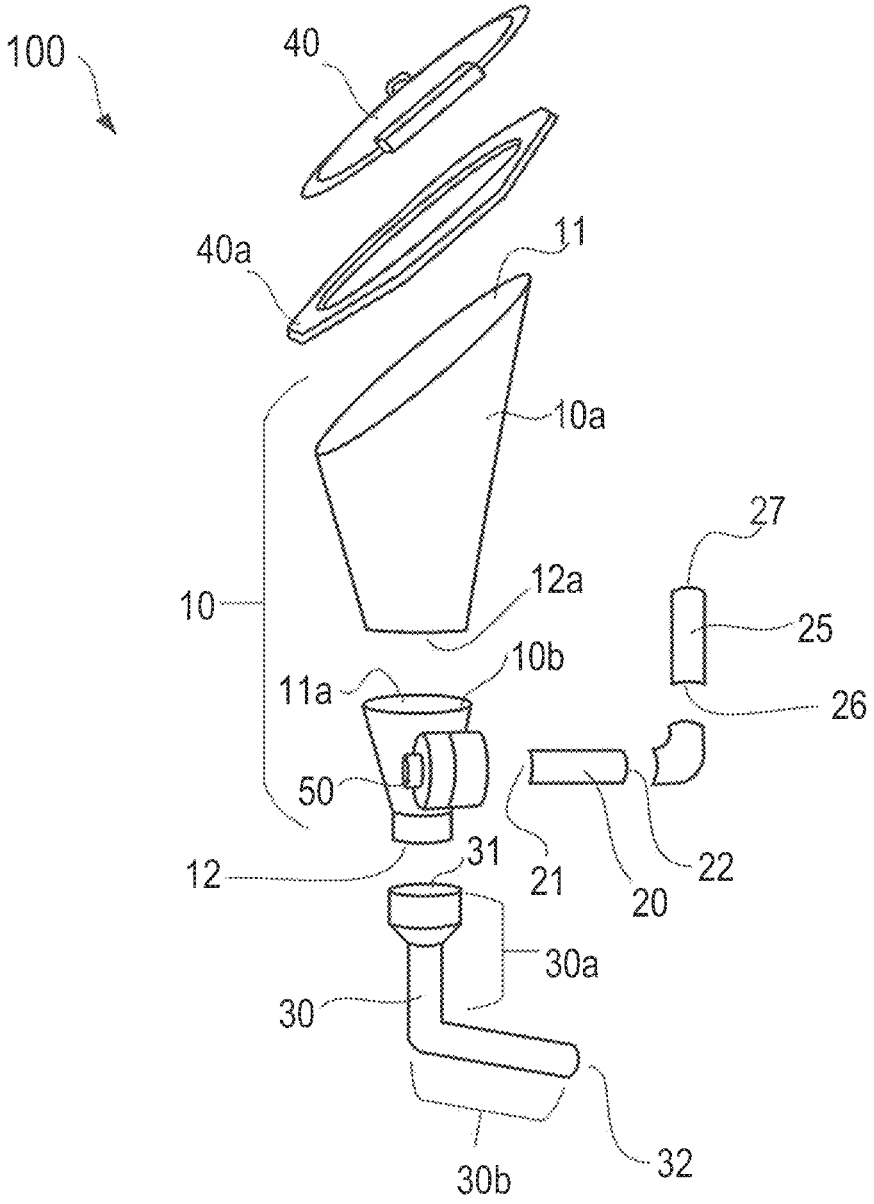
FIG. 2 is an exploded side view of a urine-harvesting urinal, in accordance with an embodiment of the present description.

FIG. 2 is an exploded side view of the urine-harvesting urinal of FIG. 1 and provides additional details on many of the components. Components with like-numbered labels common to both FIG. 1 and FIG. 2 shall be assumed to have a similar function unless otherwise specified, and therefore descriptions of these components may not be repeated from FIG. 1. Looking at FIG. 2, urine-harvesting urinal 100 may include a collection conduit 10 (which may have an upper section 10*a* and a lower section 10*b*), a first venting conduit 20, a transition conduit 55 (please see FIG. 4 for transition conduit 55), and a storage conduit 30. In some embodiments, a lid 40 may cover a top opening 11 of collection conduit 10, and may, in some embodiments, be attached to top opening 11 via a flange 40*a*. In some embodiments, collection conduit 10 has a top opening 11 and a bottom opening 12. In some embodiments, collection conduit 10 may include upper section 10*a* with top opening 11 and second bottom opening 12*a*, and lower section 10*b* with bottom opening 12 and second top opening 11*a*. In such embodiments, the second bottom opening 12*a* of upper section 10*a* may interface to and communicate fluidically with second top opening 11*a* of lower section 10*b*.

In some embodiments, bottom opening 12 of collection conduit 10 interfaces to and communicates fluidically with a first opening 31 of storage conduit 30. Urine deposited in top opening 11 of collection conduit 10 passes through collection conduit 10, exits collection conduit 10 through bottom opening 12, and passes into first opening 31 of storage conduit 30. The urine passes through first section 30*a* of storage conduit 30 into second section 30*b* of storage conduit 30 and exits storage conduit 30 via second opening 32 (where it may enter an external storage tank 60, as shown in FIG. 3).

Odors and other gases created within the urine-harvesting urinal 100 may be drawn out of the system via a negative air pressure created within first venting conduit 20. Gases/vapors are pulled into a first opening 21 of first venting conduit 20, pass through venting conduit 20, and exit venting conduit 20 via second opening 22. Gases/vapors may then enter an external venting conduit 25 via first opening 26 and exit external venting conduit 25 via second opening 27.

FIG. 3 provides a side view of a urine-harvesting system 300 including urine-harvesting urinal 100 of FIGS. 1 and 2. In some embodiments, urine-harvesting system 300 includes urine-harvesting urinal 100, an external venting conduit 25, and one or more storage tanks 60, connected to urine-harvesting urinal 100 by storage conduit 30. In some embodiments, storage tank 60 may be located in an external location (e.g., outside of a structure housing urine-harvesting urinal 100) and may be buried in the ground. In some embodiments, storage tank 60 may be a sealed, airtight, ventless tank, which collects urine through storage conduit 30 but does not allow gases/vapors to exit storage tank 60. In some embodiments, a minimum slope or pitch for storage conduit 30 (or at least second section 30*b* of storage conduit 30) may be at least 1:12, to allow for relatively quick transfer of the urine to storage tank 60 in order to minimize sedimentation and settling of minerals (and loss of nutrients from the collected urine) in the storage conduit 30. Collected urine may then be removed from storage tank 60 as needed and applied directly to agricultural crops and other plants.

Figure 4A:
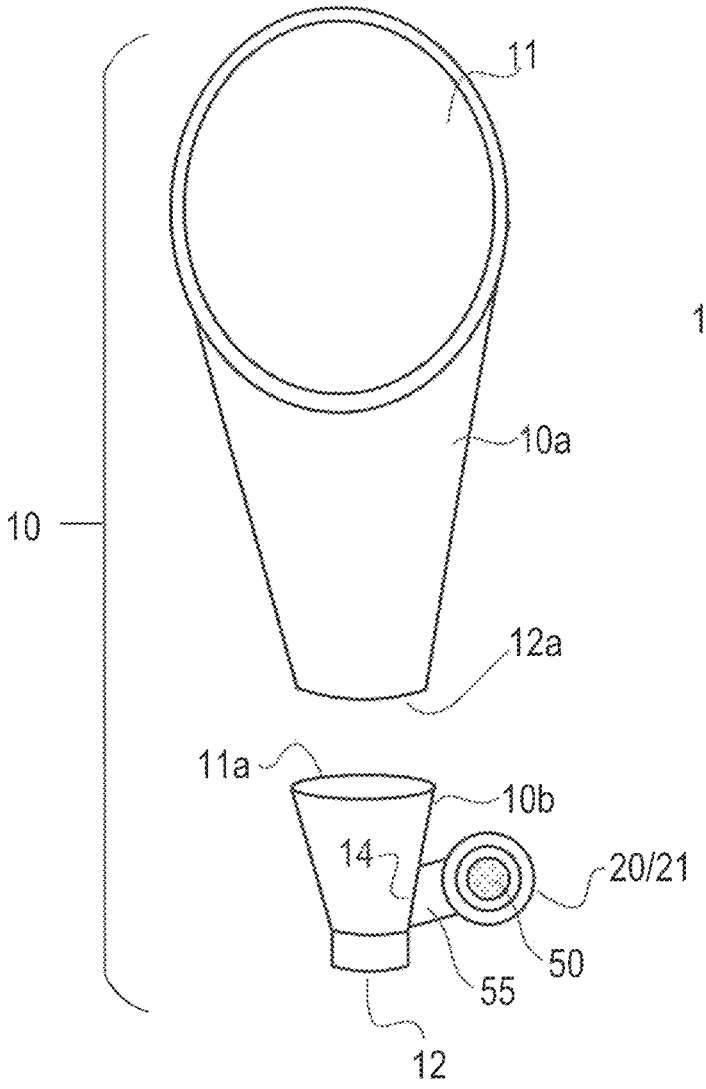
FIGS. 4A and 4B provide additional views of a collection conduit for a urine-harvesting urinal, in accordance with an embodiment of the present description.
Figure 4B:
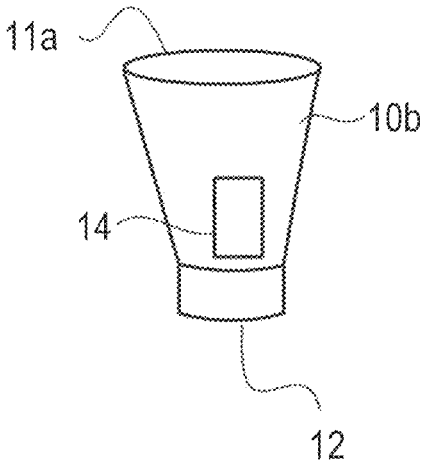

FIG. 4A provides a front view of a collection conduit 10 for a urine-harvesting urinal, showing additional details. In some embodiments, collection conduit 10 may include an upper section 10*a* and a lower section 10*b* (although, in other embodiments, these two sections may be combined into a one-piece collection conduit 10). In some embodiments, collection conduit 10 has a top opening 11, a bottom opening 12, and a side opening 14. It should be noted that side opening 14 is an opening in the side of lower section 10*b* which leads into transition conduit 55, and is not visible in FIG. 4B (although its approximate location is indicated). Side opening 14 may be more clearly seem in FIG. 4B, which shows only lower section 10*b* of collection conduit 10, rotated 90 degrees so that side opening 14 is facing out of the page. Side opening 14 is shown in FIG. 4B as a rectangular hole in the side of lower section 10*b*. However, side opening 14 may be any appropriate shape required to mate with an opening of transition conduit 55 (e.g., a round or elliptical opening to mate to a corresponding cylindrical transition conduit 55).

Transition conduit 55 connects side opening 14 to corresponding first opening 21 in first venting conduit 20. It should be noted that, in the perspective of FIG. 4A, first venting conduit 20 extends into the page (i.e., away from the viewer) and therefore is seen only as a circular cross section in FIG. 4A. First opening 21 and first venting conduit 20 can be seen in additional detail in FIGS. 1-3.

In some embodiments, an operator control 50 for opening lid 40 (see FIG. 1) may be disposed on an external surface of the urine-harvesting urinal. In FIG. 4A, operator control 50 is shown mounted on an external closed surface of first venting conduit 20. However, operator control 50 may be located in any appropriate position, and may be, for example, a foot-operated switch, a shin-bump switch, a pushbutton, a hand control, or a simple mechanical handle used to open lid 40.

Figure 5:
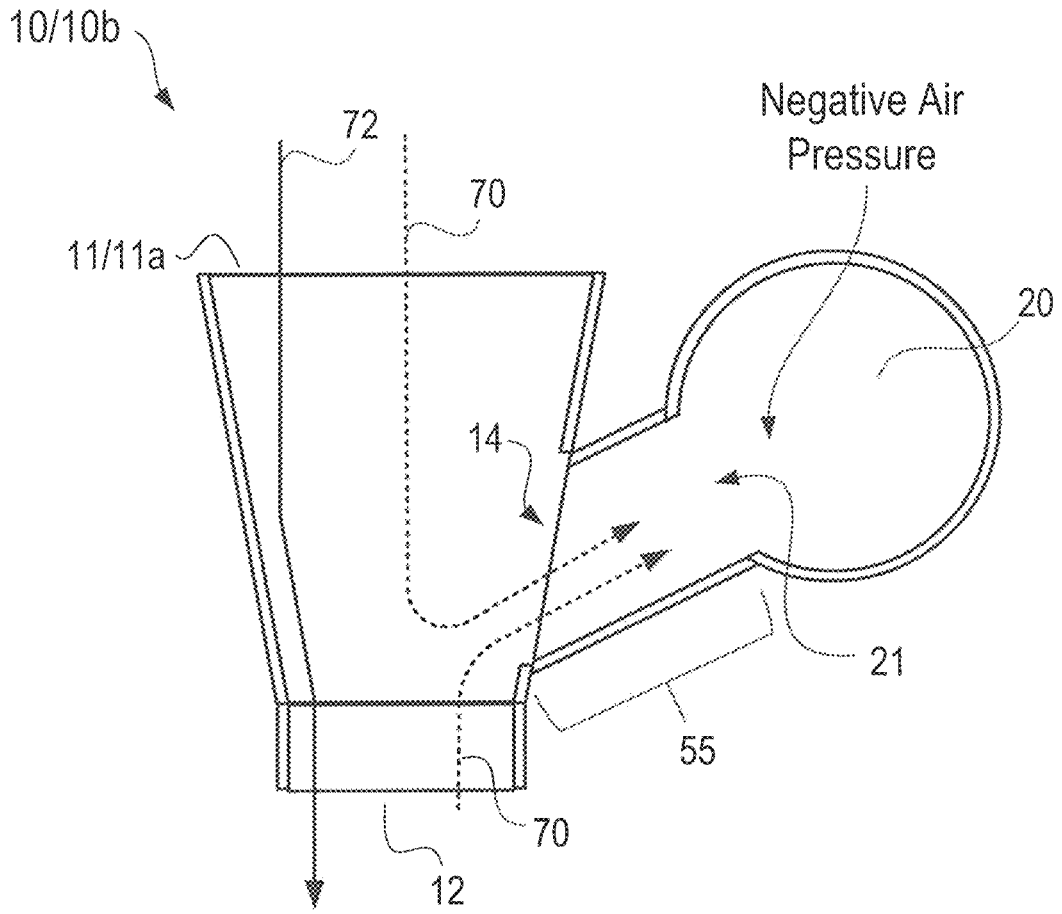
FIG. 5 is a cutaway view of a portion of a collection conduit for a urine-harvesting urinal, in accordance with an embodiment of the present description.

FIG. 5 is a cutaway view of a portion of a collection conduit 10 (or, in some embodiments, lower section 10*b* of collection conduit 10) showing additional internal details, as well as fluid flow patterns. In some embodiments, urine 72 is deposited into first opening 11/11*a* of collection conduit 10/10*b*. The sides of collection conduit 10/10*b* act to direct urine 72 toward bottom opening 12, where urine 72 exits collection conduit 10/10*b* (e.g., passing into storage conduit 30). The sides of collection conduit 10/10*b* should be disposed at an angle steep enough to facilitate the transfer of urine 72 through the bottom opening 12, and may be steeply slanted in a funnel shape or may be substantially vertical.

In some embodiments, a transition conduit may connect side opening 14 in collection conduit 10/10*b* to a corresponding opening (e.g., first opening 21) in first venting conduit 20. It should be noted that, although first opening 21 is shown in FIGS. 1-2 as an open end of first venting conduit 20, first opening 21 may also be an opening in the side of first venting conduit 20. It should also be noted that some of the figures may show transitional pieces (e.g., fixture pieces, such as collars, flanges, or adaptors) which are not separately labeled and are assumed to be either extensions of other conduit components or standard hardware/fixtures known in the industry, and therefore not described herein.

In some embodiments, gases/vapors 70, which may come from within the collection conduit 10/10*b* or up from storage conduit 30, may be drawn up into side opening 14, through transition conduit 55, and into first venting conduit 20. In some embodiments, first venting conduit 20 may possess a negative air pressure, which works to draw gases/vapors 70 out of collection conduit 10/10*b* toward an external venting location. In some embodiments, this negative air pressure may be created naturally (e.g., without an exhaust fan) by the arrangement of the components and conduits. For example, in some embodiments, transition conduit 55 may have an upward slope leading from side opening 14 up into first venting conduit 20, and first venting conduit 20 may be in turn connected to a substantially vertical external venting conduit leading to an external venting location. This arrangement and configuration of components and conduits may create a natural flow of air from inside the collection conduit 10/10*b* to the external venting location.

Figure 6A:
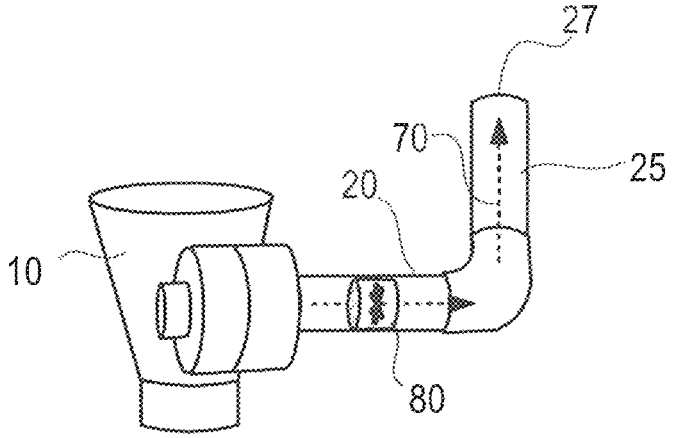
FIGS. 6A-6C show variations for an external venting system for a urine-harvesting urinal, in accordance with embodiments of the present description.
Figure 6B:
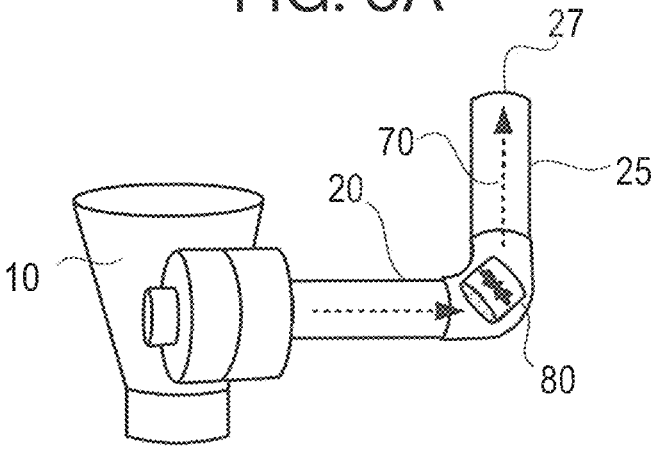
Figure 6C:
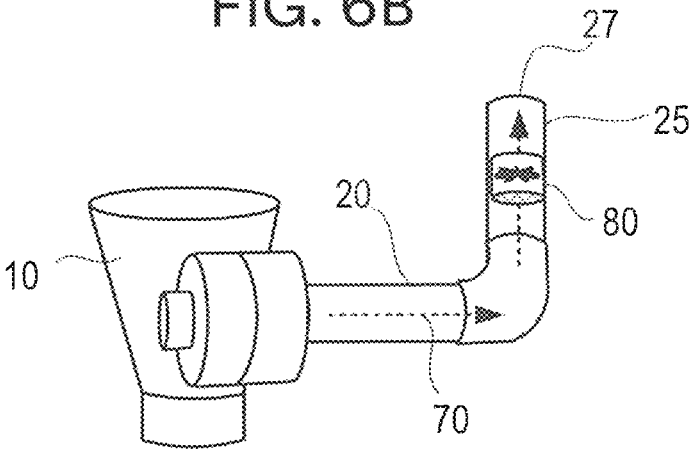

In other embodiments, the creation of a negative air pressure may be aided by an exhaust fan or similar electrical or mechanical device. For example, FIGS. 6A-6C show various embodiments of a portion of urine-harvesting urinal 100 showing different installation locations for an exhaust fan 80. In FIG. 6A, an exhaust fan 80 is disposed within and in-line with first venting conduit 20. Gases/vapors 70 are drawn through exhaust fan 80 and first venting conduit 20 and pass into external venting conduit 25 such that they are released via second opening 27 of external venting conduit 25. In FIG. 6B, exhaust fan 80 is disposed between first venting conduit 20 and external venting conduit 25 (e.g., in a bend/fixture connecting the conduits). In FIG. 6C, exhaust fan 80 is disposed within and in-line with external venting conduit 25.

Figure 7:
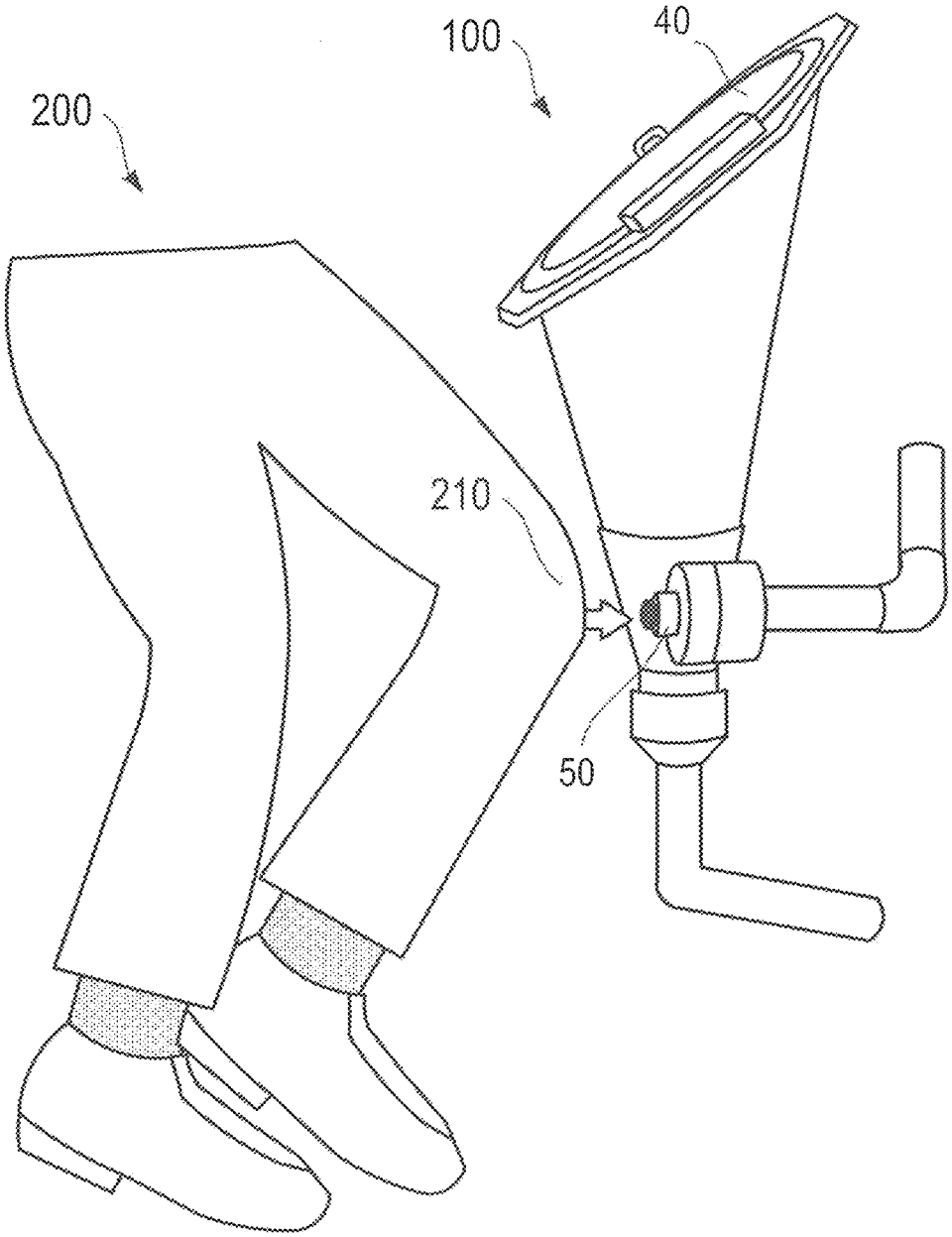
FIG. 7 illustrates the use of an operator control for use with a urine-harvesting urinal, in accordance with an embodiment of the present description.

Further, FIG. 7 illustrates the use of an operator control for use with a urine-harvesting urinal 100, according to the present description. As described elsewhere herein, urine-harvesting urinal 100 may have an externally-mounted operator control 50 for opening and closing lid 40. In some embodiments, as shown in FIG. 7, operator control 50 may be a shin-bump switch which is activated by the forward movement of the front part 210 (e.g., a knee or shin) of a leg of a user 200. A shin-bump switch is one example only, and not intended to be limiting. Operator control 50 may be any appropriate operator control (e.g., a pushbutton, a foot switch, etc.) and may be disposed in any external location relative to the urine-harvesting urinal 100 (including on an external surface of the urine-harvesting urinal 100 or in a remote location, not physically in contact with the urine-harvesting urinal 100).

Figure 8:
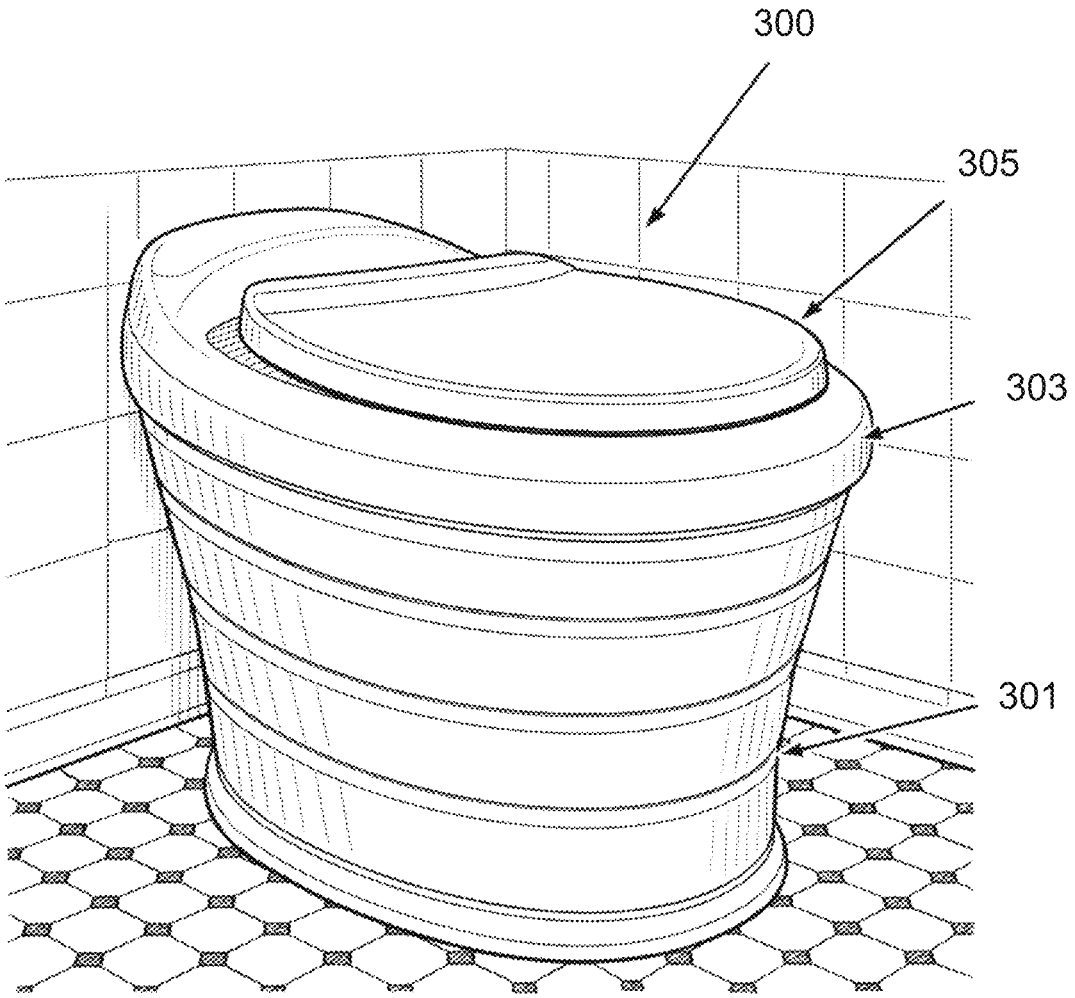
FIG. 8 is a side view of a urine harvesting urinal, in accordance with one embodiment of the present description.

Additional embodiments of the system and method can further comprise at least one bin to collect humanure. FIG. 8 illustrates another embodiment of a urine harvesting urinal 300. The urine harvesting urinal 300 of FIG. 8 can comprise a base 301, a seat 303, and a lid 305. As described throughout the application, the urine harvesting urinal 300 can be connected to at least one storage tank. In some embodiments, the system can comprise a plurality of urine harvesting urinals. Various configurations of the urine harvesting urinals can be used within the system as described herein. Urine which flows from one or more toilet(s) to (a) drain pipe(s) which can be configured to connect with (a) drain pipe(s) from one or more companion urine harvesting urinal (s) for females and (a) urinal(s) for males installed in any given structure to one of at least two ventless tanks. In one embodiment, the storage tank can comprise a 200 gallon vessel. In other embodiments other sized containers can be used depending on the use characteristics and storage area provided for the ventless tanks.

Figure 9:
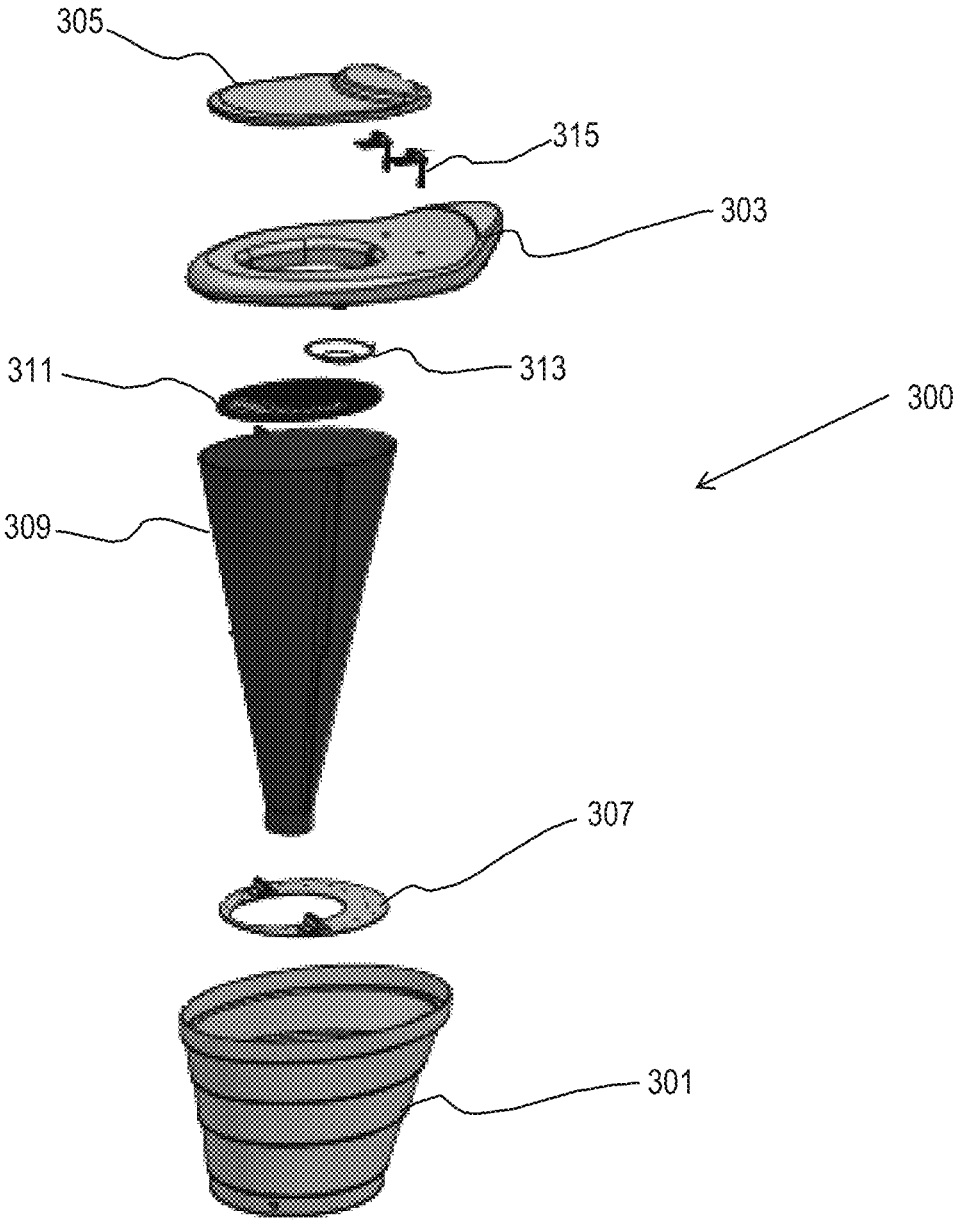
FIG. 9 is an exploded side view of a urine-harvesting urinal, in accordance with an embodiment of the present description

FIG. 9 illustrates an exploded side view of the urine-harvesting urinal 300 of FIG. 8 and provides additional details on many of the components. The urine-harvesting urinal 300 comprises a base 301, a mounting plate 307, a funnel 309, a screen 311, a deflector plate 313, a seat 303, a hinge 315, and a lid 305. The mounting plate 307 can be used to mount the base 301 to a floor or other structure. The funnel 309 can sit within the base 301 and direct urine to another portion of the system as described herein. The screen 311 and deflector plate 313 can sit within the funnel 309 and screen contaminants and direct urine within the system. The seat 303 can sit on top of the base 301. The lid 305 can couple to the seat 303 with the hinge 315 and can cover an opening in the base 301.

Figure 10:
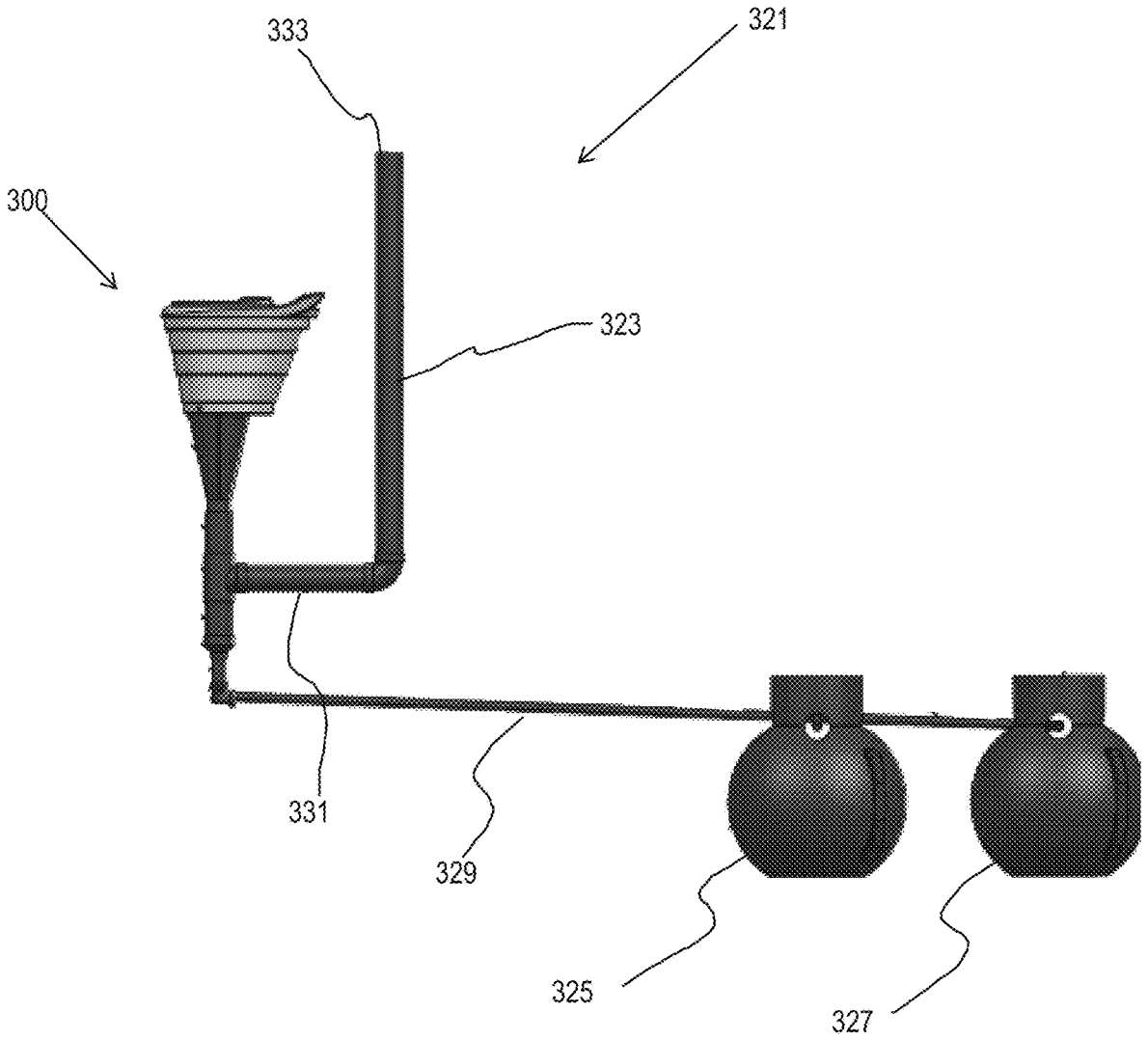
FIG. 10 is a side view of a urine-harvesting system including a storage tank, in accordance with an embodiment of the present description.

FIG. 10 provides a side view of a urine-harvesting system 321 including a urine-harvesting urinal 300 of FIGS. 8 and 9. In some embodiments, urine-harvesting system 321 includes urine-harvesting urinal 300, an external venting conduit 323, a first storage tank 325, and a second storage tank 327, connected to urine-harvesting urinal 300 by storage conduit 329 In some embodiments, the first storage tank 325 and second storage tank 327 may be located in an external location (e.g., outside of a structure housing urine-harvesting urinal 300) and may be buried in the ground. In some embodiments, the first storage tank 325 and second storage tank 327 may each be a sealed, airtight, ventless tank, which collects urine through storage conduit 329 but does not allow gases/vapors to exit THE storage tank. In some embodiments, a minimum slope or pitch for at least a portion of the storage conduit 329 can be at least 1:12, to allow for relatively quick transfer of the urine to one of the storage tanks in order to minimize sedimentation and settling of minerals (and loss of nutrients from the collected urine) in the storage conduit 329. Collected urine may then be removed from either the first storage tank 325 or the second storage tank 327 as needed and applied directly to agricultural crops and other plants. The external venting conduit can further comprise a first venting conduit 331 and aa venting opening 333. The venting opening 333 can be used to move air away from the urine harvesting urinal 300 as described herein.

In the embodiment illustrated in FIG. 10 at least two ventless tanks are required at each site to allow the urine to remain stored for at least 60 days to assure safe handling. Urine flowing from one or more devices in the structure could possibly carry pathogens which would then flow into the tank. As the urine flows to the tank the nitrogen rich urea begins to degrade. This degradation continues and the urea is converted to ammonia in which the nitrogen then resides. The pH in the tank climbs to near 10. This basic environment will eventually destroy any pathogens that may have been suspended in the ammonified solution. Sixty days will assure that the solution is pathogen free. With at least two tanks at a given site then one tank is available to receive the urine flow from the device(s) while the contents in the other tank is "self-sanitizing". In other embodiments, a full or partially full ventless tank can be removed for storage while a new tank is installed to collect urine from the system.

The urine can be stored in sealed ventless tanks so as to maintain a constant vacuum in the tanks by the fan and/or the chimney effect created in the exhaust vent. As mentioned above this is an important step because the most valuable portion of the urine in terms of its fertilizer value is the nitrogen. Because the nitrogen resides in the ammonia in the stored urine it should not be allowed to be exposed to the atmosphere or the ammonia would volatilize and the nitrogen in it would be lost. However, in some embodiments, exposure can occur, but decreased yield should be expected.

Figure 11:
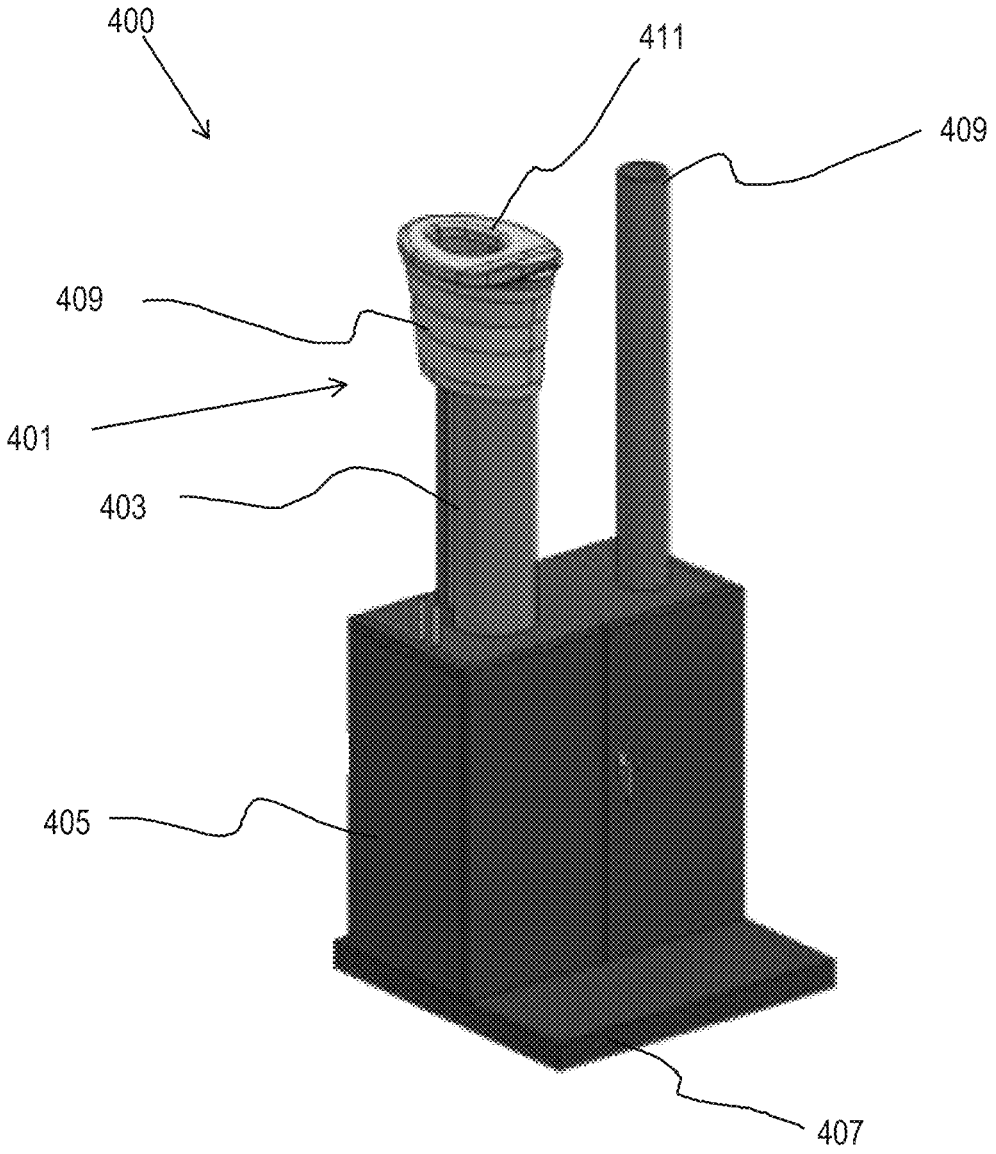
FIG. 11 is an isometric side view of a bodily waste harvesting system, in accordance with an embodiment of the present description.

FIG. 11 illustrates another portion of a bodily waste harvesting system 400. The bodily waste harvesting system 400 can comprise a waste harvesting toilet 401, a chute 403, an enclosure 405, an enclosure base 407, and a vent pipe 409. The waste harvesting toilet 401 can comprise a base 409 and a lid 411 as described herein. The chute 403 can direct solid waste from the waste harvesting toilet 401 to at least one bin within the enclosure 405. The vent pipe 409 can direct air away from the enclosure 405 and waste harvesting toilet 401.

In one embodiment, a bracket/holder can be attached to a lower surface of the seat, located behind the opening and following the contour of the back of the opening in the seat. This bracket/holder can allow placement of a removable contoured shield whose purpose it is to deflect and prevent fecal material from coming into contact with the chute assembly. The shield can comprise a top flange perpendicular to its vertical contoured surface so that it can easily be removed for cleaning and replaced afterwards by sliding it out of and back into the contoured bracket/holder attached to the lower surface of the seat.

In another embodiment, beneath the seat, the toilet base can sit on and is fastened to the floor. It bears the weight of the seat and user. The fluted, tapered shape provides the greatest compression strength with least amount of material. The shape makes the toilet base stackable, which along with its light weight can reduce shipping costs. The base can be made of ABS plastic (or other material with similar physical properties) and can be shaped employing vacuum thermoforming methodology, as is the aforementioned chute assembly comprising a chute in two parts and a deep funnel shaped urinal.

The seat can rest on top of the chute assembly and the toilet base. The chute assembly can extend through the floor to which the toilet base is fastened. The chute assembly can be fastened to the top of a thermophilic aerobic digester (TAD) cabinet enclosure, which rests on a TAD enclosure base, which rests on the floor of the story or lower level directly beneath the toilet base in the structure in which it is installed.

An inline fan can be located in the exhaust vent pipe. In one embodiment, the inline fan can run continuously. The inline fan can be positioned at the point where the vent pipe starts a vertical ascent without hindrance of bends, terminating outside of the structure where the toilet is installed. In one embodiment, the vent pipe can terminate through the roof of the structure in which it is installed. The termination of the exhaust pipe can be in a position where the airflow will not likely be impeded by downdrafts i.e. above or near the highest point of the roof.

This exhaust system can continually pull air through the air inlet on the lower, left side of the TAD which assures that there is a constant supply of air flowing through the TAD. It also produces a negative air pressure within the TAD, which means when the toilet lid opens there is a downdraft at the opening in the seat. Therefore, use of the toilet can be completely odorless.

Figure 12:
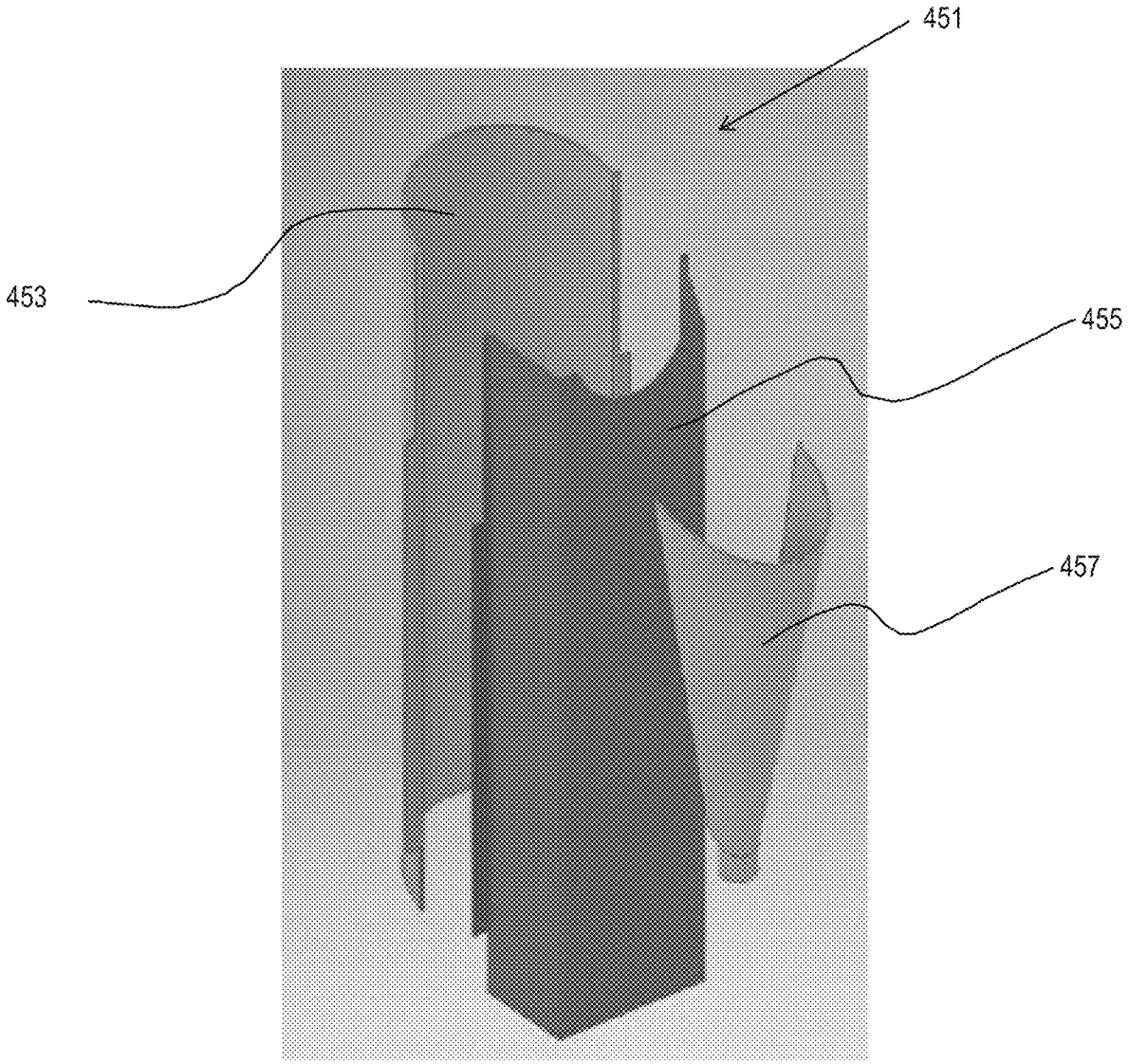
FIG. 12 is an exploded side view of an internal portion of a waste harvesting toilet.

FIG. 12 illustrates an exploded view of an internal portion of the chute 403 of FIG. 11. The internal chute 451 can comprise a chute back 453, a divider 455, and a urinal funnel plate 457. The divider 455 can separate solid waste from urine as it enters the chute and direct solid waste to the enclosure while urine is directed to a urine harvesting system as described herein. The cross-sectional shape of the chute assembly can be defined by the opening in the toilet seat with the chute assembly cross-section deeper in the back portion, and truncated across the front portion in a straight line shared by the back of the urinal funnel, forming a septum between the chute and the urinal funnel for the length of the chute.

Figure 13:
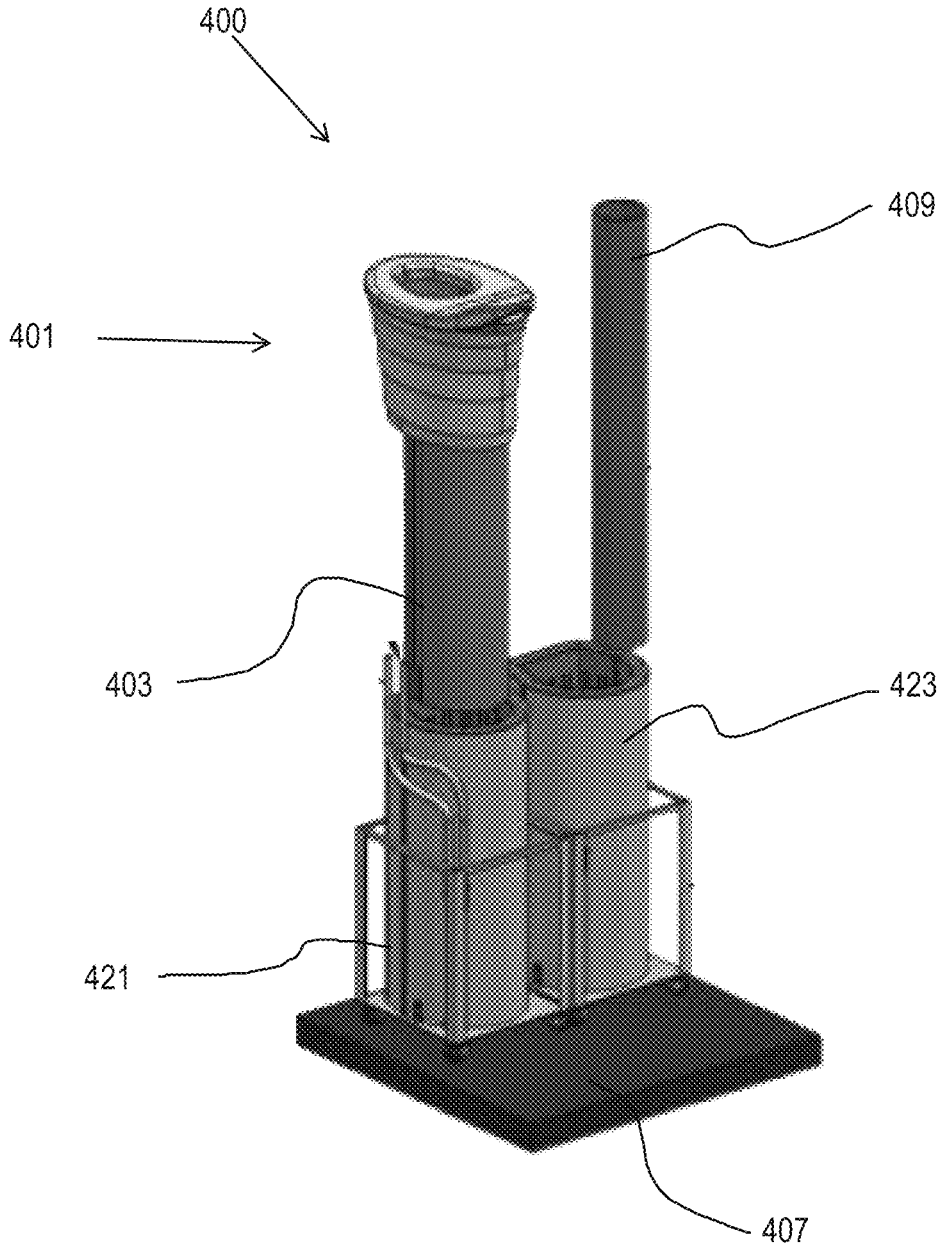
FIG. 13 is an isometric side view of a bodily waste harvesting system, in accordance with an embodiment of the present description.

FIG. 13 illustrates the waste harvesting system 400 of FIG. 11 without the outer enclosure. The waste harvesting system 400 can comprise a waste harvesting toilet 401, a chute 403, a first movable bin 421, a second movable bin 423, a vent pipe 409, and an enclosure base 407. The TAD enclosure cabinet can house two identical movable bins described as follows: Four dual-wheel casters can be mounted at the corners on the bottom of a square aluminum base plate. Four aluminum angles can be welded at the four corners to stand perpendicular to the base plate. At the top of the four vertical aluminum angles, four horizontal angles can be welded to effectively create a cube of the eight angles with the square base plate making one side of the cube. On top of each corner of the top of that aforementioned cube an isosceles triangle gusset plate can be welded to provide structural strength to the cube. In the gusset plate on the front right side of each movable bin assembly there can be two holes through which thermal (high temperature) hose is run to hold the hose in place. The cross-section of the bins can be determined by that of the chute as described above. In the illustrated embodiment it is more than twice as tall as the width of the aluminum angle cube within which the bins stand. The cross-section of the bins can vary in other embodiments. The function of the bins is to receive and contain feces, toilet paper and a carbonaceous additive i.e. sawdust, rice hulls, chopped crop residue, peat moss etc.

As described herein, urine can be captured by the urine funnel situated directly under the front portion of the opening that functions simultaneously as both a drain and a vacuum system to prevent valuable nitrogen bearing ammonia gasses from escaping into the atmosphere. The funnel can be connected to the chute near the top of the chute where they share a straight intersection along the front of the chute and back of the funnel to form a septum that separates the two components (chute in the back—funnel in the front). The bottom of the deep funnel culminates in a conduit in which the urine is conveyed to one of at least two ventless storage tanks as described herein. The configuration of the exhaust system discussed above creates a vacuum in the urine storage tanks precisely because they are ventless. The vacuum is needed to prevent the nitrogen bearing ammonia from volatilizing and escaping through the exhaust vent and into the atmosphere.

Figure 14:
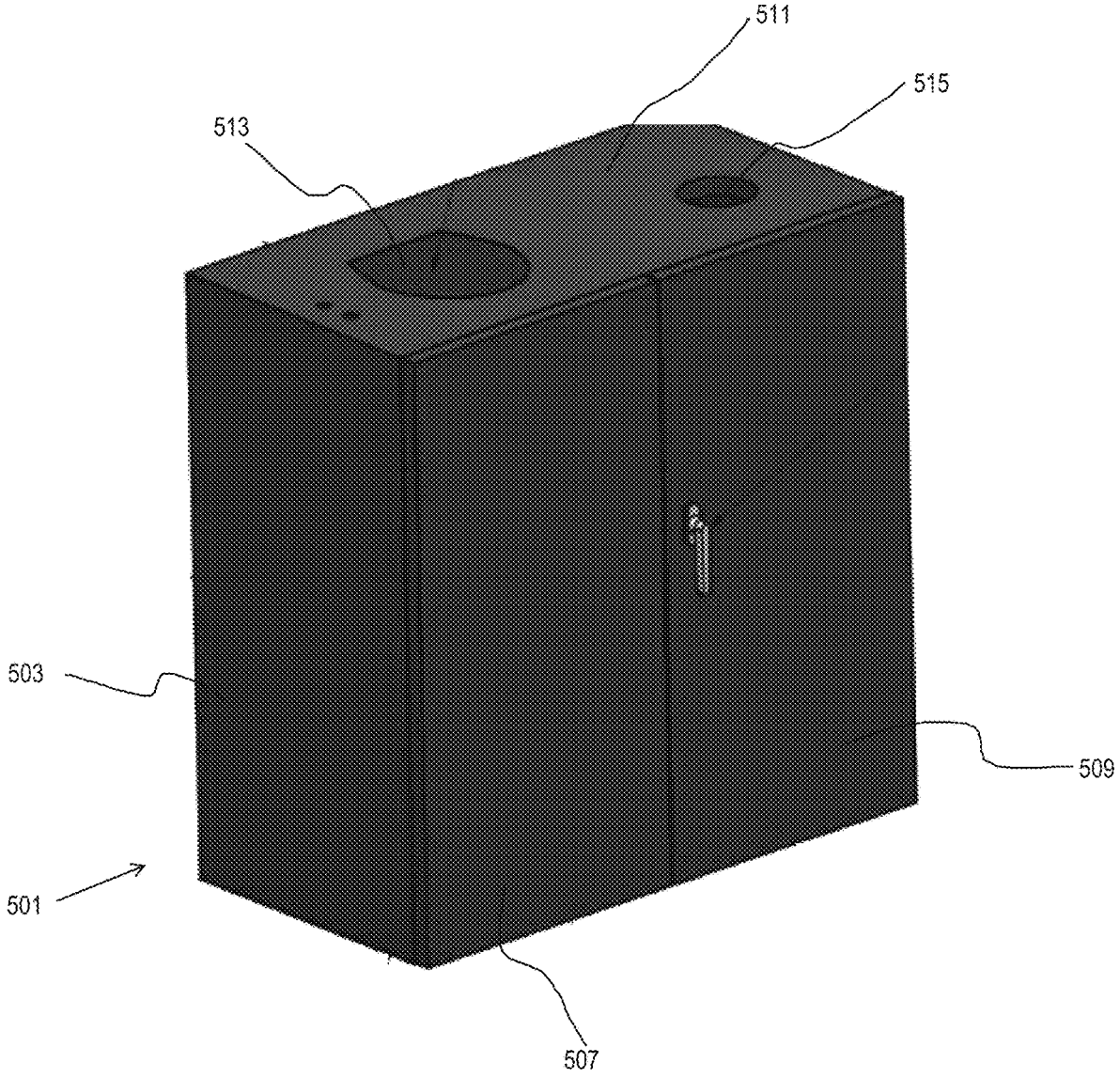
FIG. 14 is an isometric side view of an enclosure, in accordance with an embodiment of the present description.

FIG. 14 illustrates an enclosure 501. The enclosure 501, can comprise a first side panel 503, a second side panel, a first door 507, a second door 509, a top panel 511, a chute opening 513, and a vent opening 515. In one embodiment, the 2 side panels; 1 top panel; 1 back panel; 1 base panel; and 2 hinged doors opposite the back panel which comprises the front of the TAD cabinet enclosure, can comprise double-walled with insulating material between the walls. The top panel can comprise six openings. One through which the chute assembly can pass and terminate just inside the top panel to which the chute assembly is attached via a flange. This opening can located on the left side of the top panel while facing the front or door-side of the TAD. The second opening can be located on the right side of the top panel. This opening can be for an air exhaust vent which is attached also via a flange to the top panel. Finally, there are four openings through which four plumbing pipes pass; two on the left front side of the top panel and the other just right of center on the right front top. Finally, located on the lower, left side panel there is an air inlet opening. This positioning can be altered in various embodiments according to structural considerations.

Figure 15:
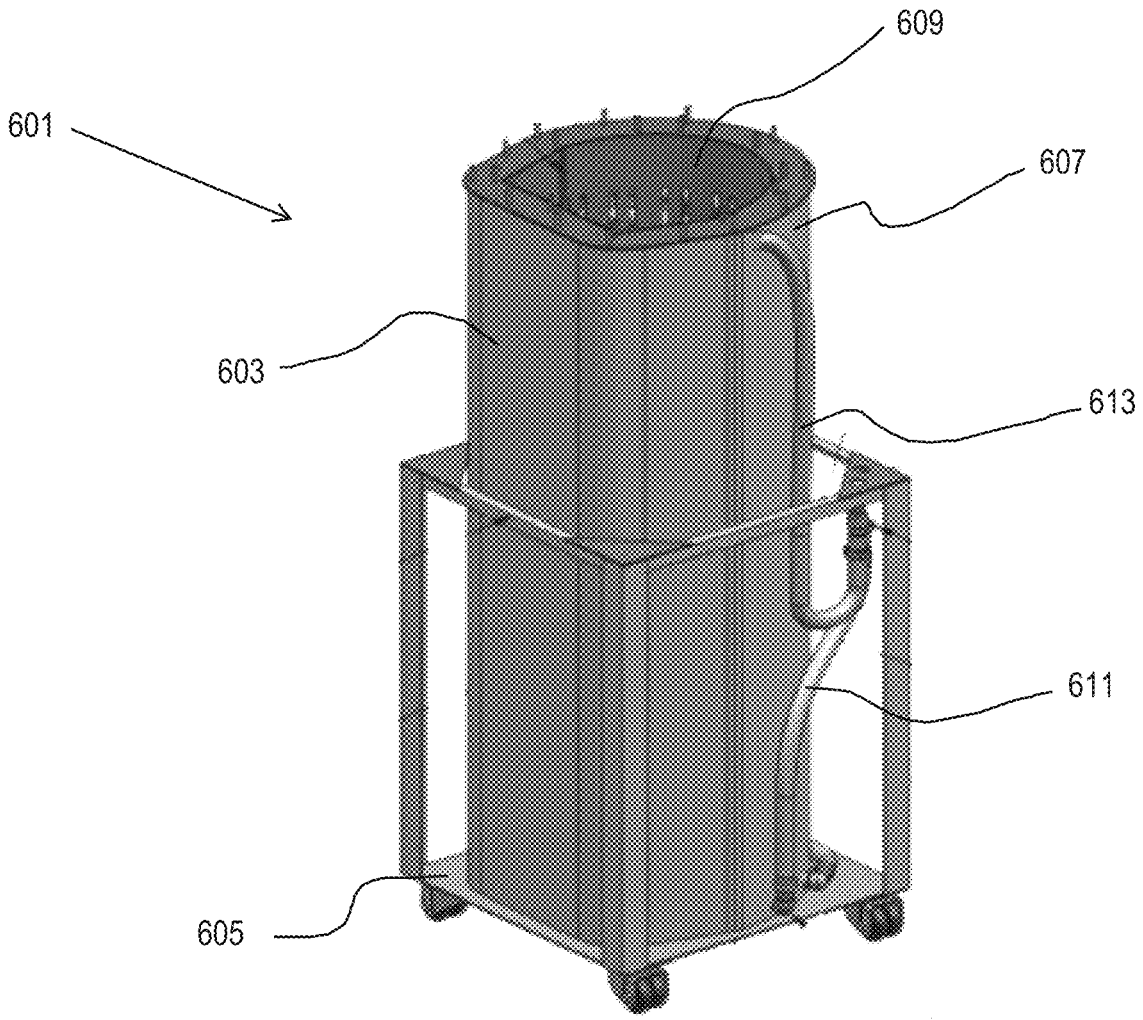
FIG. 15 is an isometric side view of a movable bin assembly, in accordance with an embodiment of the present description.

FIG. 15 illustrates a movable bin assembly 601 as described herein. The movable bin assembly 601 can comprise a movable bin 603 and bin carrier 605. The movable bin 603 can comprise an outer covering 607, a collection area 609, a first thermal hose 611, and a second thermal hose 613. The first thermal hose 611 and second thermal hose 613 can direct water to a water circulation system within the movable bin 603, under the outer covering 607, and around the collection area 609 of the movable bin 603.

Figure 16:
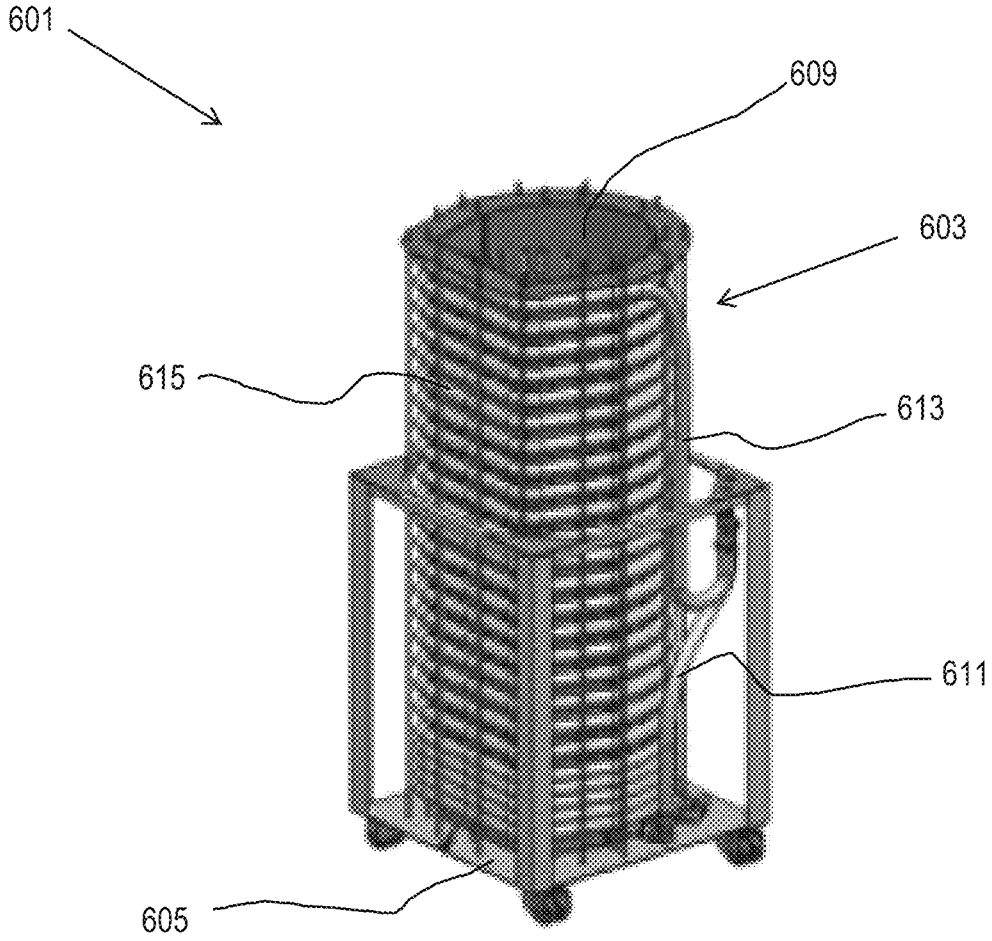
FIG. 16 is an isometric side view of the internal portion of a movable bin assembly, in accordance with an embodiment of the present description.

FIG. 16 illustrates the movable bin assembly 601 of FIG. 15 with the outer covering removed. The movable bin 603 can comprise the collection area 609, the first thermal hose 611, the second thermal hose 613, and a hose coil 615. The hose coil 615 can surround the collection area 609 and direct water or other thermal carrier from the first thermal hose 611 to the second thermal hose 613 while heating or cooling the collection area through heat transfer.

In one embodiment, inner and outer guide rods run through the square bin base plate and the bin top plate which sits atop a 0.75-inch diameter thermal hose coil that is tapped into a flat pan tank that sits on the bin base plate. The thermal hose encircles a vertically slotted inner-sleeve from the base plate at the bottom to the top of the guide rods and bin top plate. A vertically slotted outer-sleeve covers this assembly (from the inside) comprising: 1.) the inner-sleeve; 2.) the inner guide rods; 3.) the encircling hose coil; 4.) the outer guide rods and; 5.) a fitted woven natural fiber sack. The encircling hose (starting at the base) is coiled with 0.25-inch gaps between coils for the first 5 coils. Starting at the 6th coil the gaps expand to 0.75 inch between coils to the bin top plate. This configuration allows air to reach the humanure being held within the bin. In other embodiments, different configurations and spacings of the coil and related components can be used.

In the embodiment described above the encircling hose assembly is subsequently filled with water or similar heat transferring liquid which is heated to and maintained at a heat sufficient to induce thermophilic aerobic bacterial activity in the humanure held within the bins. External pumps circulate the water or similar medium in the coils to an external heat source to assure the heat is maintained evenly.

In another embodiment the bin assembly and the heat circulation system described above could also be effectuated by the use of a hydronic thermal jacket (HTJ). The HTJ can comprise a sealed conduit of extruded aluminum or similar material, within a larger sealed conduit to create a void between the two conduits whose cross-sections are prescribed by the chute connecting the toilet seat to the TAD. The void between the sleeved conduits can be filled with water or other liquid heat transferring solution which is also maintained at heat sufficient to induce thermophilic aerobic activity in the humanure by means of external pumps and heat sources to maintain a base level of heat. The preferred sources of the heat can comprise primarily solar thermal collectors supplemented (if necessary) by tankless spot water heaters. Within the inner conduit of the HTJ multiple vertically oriented perforated pipes can be situated against the surface of the inner conduit in order to supply air to the humanure. Both embodiments described above can utilize the same 0.75-inch fittings, quick-couplings and connecting hoses between the bins that allow easy, dripless disconnection and re-connection for emptying and moving of the bins.

In the illustrated embodiment, there are two bins housed in the TAD. In one embodiment, when the accumulated humanure in the bin located directly below the chute nears the top of that bin it will interrupt a through beam laser sensor which activates a relay switch, which in turn activates an indicator light. In one embodiment, the indicator light can be housed within a micro switch that that the user can tap to open the lid. The indicator light thus flashes when the through beam laser is interrupted. This alerts the user/owner/servicer that the toilet bin directly below the toilet and chute is full and will have to be moved into the finishing position within the next few days. To do this, the TAD doors can be opened. The exhaust fan creates a negative pressure, so when the TAD doors are opened air is pulled past the bin under the chute and out the exhaust vent. This will assure that the following process will not be accompanied by offensive odors. Additionally, the other bin (in the finishing position) must be emptied. First, the bin to be emptied must be removed from the TAD. Then the fitted woven fiber sack containing the finished humanure is removed from the bin.

In one embodiment, the second bin has been in the finishing position for at least 2 months depending on the rate of use. In that period of time the humanure in the bin has been utilized by various species of spore-forming thermophilic aerobic bacteria (SFTAB) that occur naturally in a person's gut. In one embodiment, the hot water bath in which the humanure has been immersed over that period of time (in the form of either the encircling hydronic coils or the HTJ) has been maintained at a temperature of 45 degrees C. (~110 F). It essentially creates a hot water bath and total immersion. This creates a uniform and steady heat source that can be maintained at a much lower temperature to achieve the same results. Heat does not dissipate in the humanure as it accumulates in the bins. This is the temperature at which the various species of SFTAB can become active. A chain reaction of activity is sparked as different species reproduce rapidly and decline to be replaced by another. Temperatures within the humanure/fuel/food reach to the 70-80 C range (160-175 F). This heat destroys other bacteria and viruses that may have resided in the humanure. The process also desiccates and greatly reduces the volume of the humanure. The resulting mass of less than 2 cubic feet (for the size of the bins in this embodiment) is very light weight, and it is essentially odorless. In other embodiments, additional temperatures or temperature ranges can be used in the hot water bath. In one embodiment, a temperature of at least 45 degrees C. can be used. The temperature or range of temperatures available for use in the hot water bath to activate the various species of SFTAB can also vary by region, climate, elevation, or other variables external to the system. These variables can result in other ranges of temperatures being effective for activating the various species of SFTAB to destroy any bacteria and viruses that may reside within the mixture. In some embodiments, the humanure is mostly pathogen free, though it is not thoroughly composted. The sack is a convenient container in which to carry and transport the contents to a central location where mixing with other compostable materials such as crop residue and yard waste can take place for further composting.

A pump can be used to circulate water heated to 110 F. In one embodiment, while testing the system the temperature of the humanure was consistently in the 160-170 F range. The spot water heater through which the water circulated remained set at 110 F. Humanure samples were taken from three different bins 30, 60 and 90 days after each bin had last been used. The samples were then sent to an independent lab for the universally accepted method of testing for fecal coliform in various media: Most Probable Number (MPN/gram) of likely fecal coliform colonizing units per gram. The results were 9, 4, and 2 MPN/gram. Context: 1.) One NIH study revealed that washed, ready-to-eat, bagged, cut lettuce and spinach had values of anywhere from 3.6-9.2 MPN/gram; 2.) An EPA certified Class A Biosolid can be used as a fertilizer for food crops, and have up to 1000 MPN/gram.

Some other types of toilets only provides heat from beneath the bin. This causes it to be difficult if not impossible for heat to be maintained as the humanure mass increases. The high heat required would dry out the mass as it grows, thus impeding thermophilic activity for lack of moisture. The desiccation of the humanure would also act to insulate the heat source underneath the chamber from the waste being added, making it even less likely for heat to reach the humanure evenly as it is added.

Furthermore, in the illustrated embodiment, the system has two bins, not only making for even heat distribution but for consistent uninterrupted use. Some other types of toilets have only one bin. For that bin to be emptied hygienically it would require weeks of down time while the mass was heated. The humanure in the bins as described herein is exposed to a constant heat source requiring a low even temperature of 45 C in one embodiment. The bins requires no manipulation of the humanure via mixing mechanisms to achieve an even temperature. In other systems, when those mixing mechanisms require repairs it can be difficult and will require downtime. Further, in some embodiments the mechanisms of the system described herein—pumps, solar thermal collectors, and tankless water heaters—are located outside of the bins. This makes maintenance and repair more convenient, and most importantly, the unit can still be used. There is no downtime.

Terms such as "about" will be understood in the context in which they are used and described in the present description by one of ordinary skill in the art. If the use of "about" as applied to quantities expressing feature sizes, amounts, and physical properties is not otherwise clear to one of ordinary skill in the art in the context in which it is used and described in the present description, "about" will be understood to mean within 10 percent of the specified value. A quantity given as about a specified value can be precisely the specified value. For example, if it is not otherwise clear to one of ordinary skill in the art in the context in which it is used and described in the present description, a quantity having a value of about 1, means that the quantity has a value between 0.9 and 1.1, and that the value could be 1.

Terms such as "substantially" will be understood in the context in which they are used and described in the present description by one of ordinary skill in the art. If the use of "substantially equal" is not otherwise clear to one of ordinary skill in the art in the context in which it is used and described in the present description, "substantially equal" will mean about equal where about is as described above. If the use of "substantially parallel" is not otherwise clear to one of ordinary skill in the art in the context in which it is used and described in the present description, "substantially parallel" will mean within 30 degrees of parallel. Directions or surfaces described as substantially parallel to one another may, in some embodiments, be within 20 degrees, or within 10 degrees of parallel, or may be parallel or nominally parallel. If the use of "substantially aligned" is not otherwise clear to one of ordinary skill in the art in the context in which it is used and described in the present description, "substantially aligned" will mean aligned to within 20% of a width of the objects being aligned. Objects described as substantially aligned may, in some embodiments, be aligned to within 10% or to within 5% of a width of the objects being aligned.

All references, patents, and patent applications referenced in the foregoing are hereby incorporated herein by reference in their entirety in a consistent manner. In the event of inconsistencies or contradictions between portions of the incorporated references and this application, the information in the preceding description shall control.

Descriptions for elements in figures should be understood to apply equally to corresponding elements in other figures, unless indicated otherwise. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

Although several embodiments have been described above with a certain degree of particularity, those skilled in the art could make numerous alterations to the disclosed embodiments without departing from the present disclosure. It is intended that all matter contained in the above description or shown in the accompanying drawings shall be interpreted as illustrative only and not limiting. Changes in detail or structure may be made without departing from the present teachings. The foregoing description and following claims are intended to cover all such modifications and variations.

Various embodiments are described herein of various apparatuses, systems, and methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," "an embodiment," or the like, means that a particular feature, structure, or characteristic described in connection with the embodiment is included in at least one embodiment. Thus, appearances of the phrases "in various embodiments," "in some embodiments," "in one embodiment," "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation.

It will be appreciated that the terms "proximal" and "distal" may be used throughout the specification with reference to a clinician manipulating one end of an instrument used to treat a patient. The term "proximal" refers to the portion of the instrument closest to the clinician and the term "distal" refers to the portion located furthest from the clinician. It will be further appreciated that for conciseness and clarity, spatial terms such as "vertical," "horizontal," "up," and "down" may be used herein with respect to the illustrated embodiments. However, surgical instruments may be used in many orientations and positions, and these terms are not intended to be limiting and absolute.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. A urine-harvesting urinal, comprising:

a collection conduit comprising a top opening, a bottom opening, and a side opening disposed on a wall of the collection conduit closer to the bottom opening than the top opening;

a first venting conduit comprising a first opening near a first end of the first venting conduit and a second opening at a second end of the first venting conduit, the second opening configured to transfer air away from the collection conduit, the first venting conduit configured to provide negative air pressure;

a transition conduit, connecting the side opening of the collection conduit to the first opening of the first venting conduit;

a storage conduit comprising a first opening near a first end of the storage conduit and a second opening at a second end of the storage conduit, the first opening of the storage conduit connected to the bottom opening of the collection conduit and configured to transfer fluids away from the collection conduit toward an external storage location that includes a storage tank; and a lid disposed to cover the top opening of the collection conduit, the lid having a substantially gapless but non-airtight perimeter that permits continuous airflow into the collection conduit while the first venting conduit generates negative air pressure, wherein the transition conduit is configured to maintain the negative air pressure in the collection conduit and the storage tank.

2. The urine-harvesting urinal of claim 1, wherein the bottom opening of the collection conduit is smaller than the top opening.

3. The urine-harvesting urinal of claim 1, wherein the collection conduit comprises:

an upper section comprising the top opening and a second bottom opening; and a lower section comprising a second top opening, the bottom opening, and the side opening, wherein the second bottom opening of the upper section connects to, and communicates fluidically with, the second top opening of the lower section.

4. The urine-harvesting urinal of claim 1, further comprising an exhaust fan, the exhaust fan configured to create negative air pressure within the first venting conduit.

5. The urine-harvesting urinal of claim 4, wherein the exhaust fan is disposed within and in-line with the first venting conduit, between the first end of the first venting conduit and the second end of the first venting conduit.

6. The urine-harvesting urinal of claim 4, wherein the exhaust fan is external to the first venting conduit and in fluidic communication with the second end of the first venting conduit.

7. The urine-harvesting urinal of claim 1, wherein the transition conduit is disposed such that it provides an upward slope from the side opening of the collection conduit to the first opening of the first venting conduit.

8. The urine-harvesting urinal of claim 1, wherein the storage conduit is disposed such that it provides a downward slope from the first end of the storage conduit toward the second end of the storage conduit.

9. The urine-harvesting urinal of claim 1, further comprising the lid configured to cover the top opening of the collection conduit.

10. The urine-harvesting urinal of claim 9, further comprising an operator control to selectively open and/or close the lid.

11. The urine-harvesting urinal of claim 10, wherein the operator control is a button disposed on an exterior surface of the urine-harvesting urinal such that it is depressed by a forward movement of a user's leg, wherein depression of the button causes a signal to be provided to an electric motor, the electric motor opening or closing the lid.

12. The urine-harvesting urinal of claim 1, wherein the storage conduit is substantially linear between the first end of the storage conduit and the second end of the storage conduit.

13. The urine-harvesting urinal of claim 12, wherein a downward slope of the storage conduit is greater than or equal to 1:12.

14. The urine-harvesting urinal of claim 1, wherein the storage conduit comprises a first section and a second section, wherein the first section is substantially linear in a first direction, and the second section is substantially linear in a second, different direction.

15. The urine-harvesting urinal of claim 14, wherein a downward slope of the second section of the storage conduit is greater than or equal to 1:12, and a downward slope of the first section is steeper than the downward slope of the second section.

16. A urine-harvesting system, comprising:

the urine-harvesting urinal of claim 1, an external venting conduit comprising a first opening near a first end of the external venting conduit and a second opening near a second end of the external venting conduit, the first opening of the external venting conduit connected to the second opening of the first venting conduit of the urine-harvesting urinal and the second opening of the external venting conduit open and disposed to release gases traveling through the external venting conduit into a safe exhaust location; and at least one storage tank connected to the second end of the storage conduit.

17. The urine-harvesting system of claim 16, further comprising an exhaust fan disposed between the second opening of the venting conduit and the external venting conduit.

18. The urine-harvesting system of claim 16, further comprising an exhaust fan disposed within and in-line with the first venting conduit.

19. The urine-harvesting system of claim 16, further comprising an exhaust fan disposed within and in-line with the external venting conduit.

20. The urine-harvesting system of claim 16, wherein the storage tank is an airtight, ventless tank.

* * * * *